US006112884A

United States Patent [19]

Voorhees

[11] Patent Number: 6,112,884

[45] Date of Patent: Sep. 5, 2000

[54] IDLER ROLLER ASSEMBLY FOR A WEB-PRODUCT DELIVERY SYSTEM

[75] Inventor: Philip V. Voorhees, Willowbrook, Ill.

[73] Assignee: Western Printing Machinery Company, Schiller Park, Ill.

[21] Appl. No.: 09/005,220

[22] Filed: Jan. 9, 1998

[51] Int. Cl.[7] ..... B65G 23/44

[52] U.S. Cl. ..... 198/816; 198/813; 198/814

[58] Field of Search ..... 271/202, 182, 271/183, 184, 189, 197, 270; 198/813, 814, 815, 816

[56] References Cited

U.S. PATENT DOCUMENTS

| | | | |
|---|---|---|---|
| 1,785,141 | 12/1930 | Morton | 198/816 |
| 2,953,241 | 9/1960 | Lehman | 198/816 |
| 4,727,784 | 3/1988 | Sarka et al. | 83/26 |

*Primary Examiner*—Christopher P. Ellis
*Assistant Examiner*—Patrick Mackey
*Attorney, Agent, or Firm*—Brinks Hofer Gilson & Lione

[57] ABSTRACT

A web-product delivery system includes a top belt system with at least one top belt assembly supported and movably adjustable on a carriage. The top belt assembly includes a front assembly and a rear assembly. Both the front assembly and rear assembly include at least one idler roller assembly, and a bracket slidably attached to the carriage to allow the top belt assembly to be positioned and adjusted along a product path while product is moving along the product path. The idler roller assembly may include a roller rotatably attached to an arm, the arm pivotably attached to a bracket, a pivot shaft attached to the bracket and slidably receiving a load-bias threaded adjusting rod. The adjusting rod is screwably attached to the arm to allow the arm to rotate about the bracket through a vertical plane when the adjusting rod is turned. The web-product delivery system further includes a transition throw-off and vertical adjustment assemblies which may be operated while running.

12 Claims, 22 Drawing Sheets

IDLER ROLLER ASSEMBLY FOR A WEB-PRODUCT DELIVERY SYSTEM

FIELD OF THE INVENTION

The invention generally relates to delivery systems used in high speed processing of web-product exiting an adjacent cutting machine. More specifically, the invention relates to improvements to the delivery system used to receive web or paper-like product from an adjacent rotary cutting machine, which have been cut to length, and then place these products in a shingled stream, which may be stacked for shipping.

BACKGROUND OF THE INVENTION

In general, web-product delivery systems are used to transfer product from a cutting machine, and place the product in shingled streams. The shingled streams may then be transferred to a stacking machine or stacked by hand for insertion in shipping containers. These web-product delivery systems may accommodate a product with varying lengths, widths, and configurations. Typically, these delivery systems includes one or more top belt arrangements, and one or more bottom belt arrangements.

One problem with these conventional delivery systems is that time consuming adjustments are required to position the belt assemblies for varying product. A typical belt adjustment would require one or more individual pulley re-alignments, belt tension and contour re-adjustments, and the need to remove the belt and then return it to the belt path. This procedure requires hand tools and takes a considerable amount of time to complete. Often extra belts are left on the delivery system to avoid belt replacement downtime. These extra belts, however, are exposed to the operating forces and may be damaged or interfere with production.

Another problem encountered with conventional delivery systems is downtime caused by product jams. Wads of paper products or foreign objects passing through a nip formed between the top belt roller and bottom belt roller will typically create excessive force which may damage the system and cause severe production-stopping product jams.

Existing systems includes knock-down kicker wheels having brushes, paddles, or other similar devices which are designed to hit the trailing edge of the product as it is transitioned from a first belt traveling at a higher speed to a slower moving belt. These methods, however, may be inadequate to prevent the product from buckling as running speeds increase.

It would be desirable to have web-product delivery system that would eliminate the above problems and other problems associated with existing web-product delivery systems.

SUMMARY OF THE INVENTION

One aspect of the invention provides a web-product delivery system comprising a top belt system including at least one top belt assembly supported and movably adjustable on a carriage. The top belt assembly includes a front assembly and a rear assembly. The front assembly includes at least one idler roller assembly and a bracket slidably attached to the carriage. The rear assembly includes at least one idler roller assembly and a bracket slidably attached to the carriage. The top belt assembly may be positioned and adjusted across a product path while product is moving along the product path. The system may include a plurality of top belt assemblies. Each top belt assembly is movable on the carriage and adjustable independent of any of the other top belt assemblies. The top belt assembly may further include a belt, which is adapted to be independently adjusted in an independent profile above a product path. The system may further comprise a locking knob rotatably attached to each bracket to allow the top belt assembly to be secured to the carriage.

A further aspect of the invention provides a method of operating a web-product delivery system. The top belt system including at least one top belt assembly, described above, is provided. The top belt assembly is slid into a desired position along the carriage above, above the product path. When a plurality of top belt assemblies are used, each of the top belt assemblies may be positioned above the product path independent of any other top belt assembly. The method may further comprise a locking knob on the front assembly and rear assembly. The knobs may be loosened to allow movement of the top belt assembly along the carriage.

A further aspect of the invention provides a web-product delivery system comprising a belt assembly movably adjustable on a carriage. The belt assembly includes at least one idler roller assembly. The idler roller assembly includes a roller rotatably attached to an arm, with the arm pivotably attached to a bracket. The pivot shaft is attached to the bracket and slidably receives a load-biased threaded adjusting rod. The adjusting rod screwably attaches to the arm to allow the arm to rotate about the bracket through a vertical plane when the adjusting rod is turned. This system may comprise an auxiliary idler roller assembly which may slide in the direction of the product path, along a bar. The system may further comprise a compression spring communicating with the adjusting rod to provide the load-bias. The compression spring may preferably be positioned between the pivot shaft and a stop member attached to the adjusting rod. The system may further include a throw-off assembly to slacken the belt.

A further aspect of the invention provides a method of operating a web-product delivery system which comprises a belt assembly movably adjustable on a carriage having the belt assembly, described above including at least one idler roller assembly. The adjusting rod may be turned, which in turn, rotates the arm about the bracket to adjust the roller position. A compression spring communicating with the adjusting rod may preferably be provided to set the load-bias. The adjusting rod may be turned while the product is moving along the belt, and thus force the adjusting rod a distance through the pivot shaft to indicate that a belt in contact with the roller is tensioned to the pre-load of the compression spring. When the portion of the belt in contact with the roller contacts a product wad or foreign object, the roller forces the arm to rotate and the adjusting rod slides through the pivot shaft to allow the wad or foreign object to pass, thus clearing the jam. A further aspect of the invention provides an idler roller assembly for use in a web-product delivery system comprising a roller rotatably attached to an arm, the arm pivotably attached to a bracket, a pivot shaft attached to the bracket and slidably receiving a load-biased threaded adjusting rod, the adjusting rod screwably attached to the arm to allow the arm to rotate about the bracket through a vertical plane when the adjusting rod is turned. The idler roller assembly may further comprise a compression spring positioned between the pivot shaft at a first end and an adjustable stop member at a second end. The stop member is adjustable to set the load-bias on the arm via the adjusting rod. Preferably, the stop member comprises a stop nut screwably attached to the threaded portion of the adjusting rod. The idler roller assembly may further comprise a screw passing through a threaded opening in the bracket. A clamping block may be attached to the bracket to allow the screw to be turned and clamp a bar portion of a carriage to the clamp block. The adjusting rod may preferably be attached to a stud which extends from and is attached to the arm.

A further aspect of the invention provides a method of operating the idler roller assembly, described above. The adjusting rod may be turned to rotate the arm about the bracket to position the roller against a belt to modify the belt profile. The method further provides for a screw passing through a threaded opening in the bracket and a clamping block attached to the bracket. The screw may be turned to secure the clamping block to a bar portion of the top assembly. The method further provides for providing a belt positioned in contact with the roller and turning the adjustment rod to a point where the pressure against the belt overcomes a pre-load compression on the rod and slides the rod through the pivot shaft to relieve the excess pressure. This allows the user to visually determine that the pre-load on the belt is set. The method further provides a stop member adjustable along the adjusting rod. The stop member may be positioned on the adjusting rod to set the load-bias. Preferably, the stop member includes a stop nut which is screwably attached to a threaded portion of the adjusting rod. The stop nut may be screwed to set the load-bias on the adjusting rod.

A further aspect of the invention provides a web-product delivery system comprising a transition wheel rotatably mounted on a shaft, the shaft rotatably attached to an arm, the arm attached to an adjusting shaft, the adjusting shaft rotatably mounted to a first lever, the first lever rotatably connected to a throw-off shaft, the throw-off shaft rotatably connected to a second lever, the second lever rotatably attached to an adjustable stop rod, a stop member attached to the adjustable stop rod to allow the transition wheel to be adjusted vertically along the product path while product is moving along the product path. The stop member preferably comprises a stop nut which is adjustable along the threaded portion of the adjustable stop rod.

A further aspect of the invention provides a method of operating the web-product delivery system comprising the transition wheel, arm, adjusting shaft, first lever, throw-off shaft, second lever, adjustable stop rod, and stop member discussed above. The adjustable stop rod is turned, and thus rotates the second lever which rotates the throw-off shaft, which in turn rotates the adjusting shaft to vertically position the transition wheel above the product path. The stop member preferably comprises a stop nut which is screwably attached to the adjustable stop rod. The stop nut may be screwed along the adjustable stop rod to pre-set the distance between the transition wheel and the product path.

A further aspect of the invention provides a web-product delivery system comprising a transition wheel rotatably mounted on a shaft, the shaft rotatably attached to an arm, the arm attached to an adjusting shaft, the adjusting shaft rotatably mounted to a first lever, the first lever rotatably connected to a throw-off shaft, the throw-off shaft fixedly attached to a throw-off lever, the throw-off lever rotatably attached to an air cylinder to allow the air cylinder to be actuated to rotate the throw-off lever which rotates the throw-off shaft, which rotates the adjusting shaft and raises the transition wheel a distance above a product path.

A further aspect of the invention provides a method of operating the web-product delivery system comprising the transition wheel, shaft, arm, adjusting shaft, first lever, throw-off shaft, throw-off lever, and air cylinder discussed above. The air cylinder is actuated to rotate the throw-off lever, which rotates the throw-off shaft to rotate the adjusting shaft and raise the transition wheel a distance above the product path.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
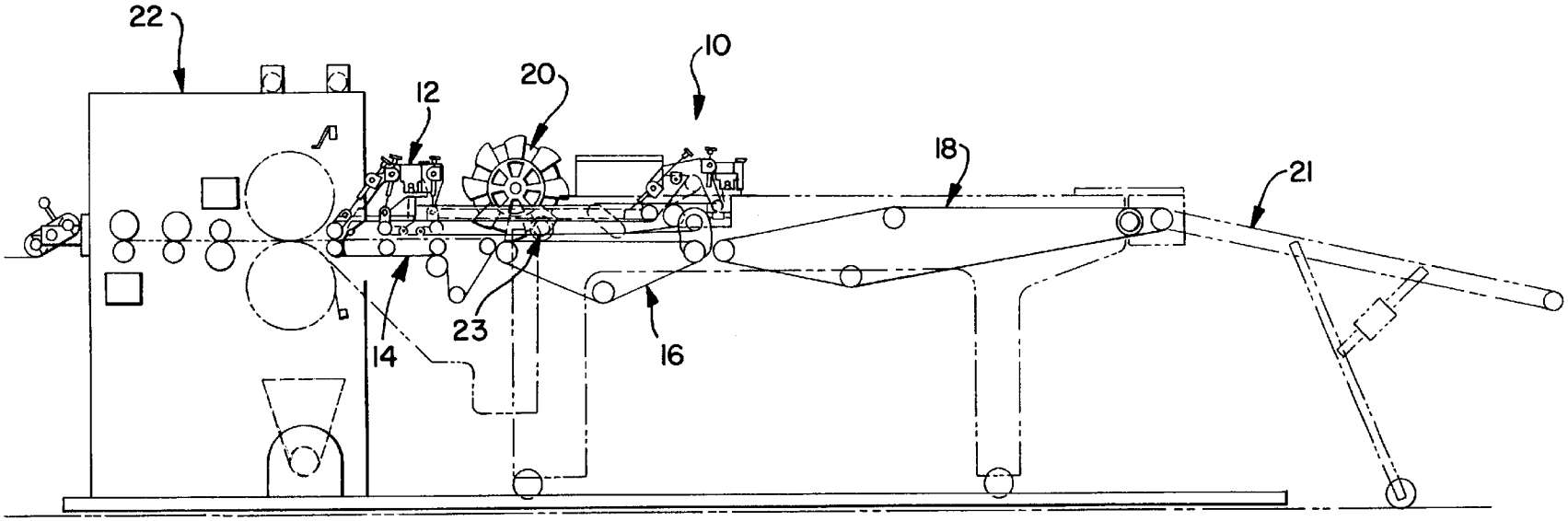
FIG. 1 is a schematic side view of a preferred embodiment of a the web-product delivery system.

Referring to FIG. 1, one preferred embodiment of the delivery system 10, includes a top belt system 12, a speed-up stage system 14, a first stage slow-down system 16, and a phaseable rotary transition wheel 20. The delivery system may further include a second stage slow-down system 18. A conveyer extension 21 may also optionally be provided. The delivery system 10 is positioned adjacent the cutting module 22 to receive the product exiting the cutting module 22.

Figure 2:
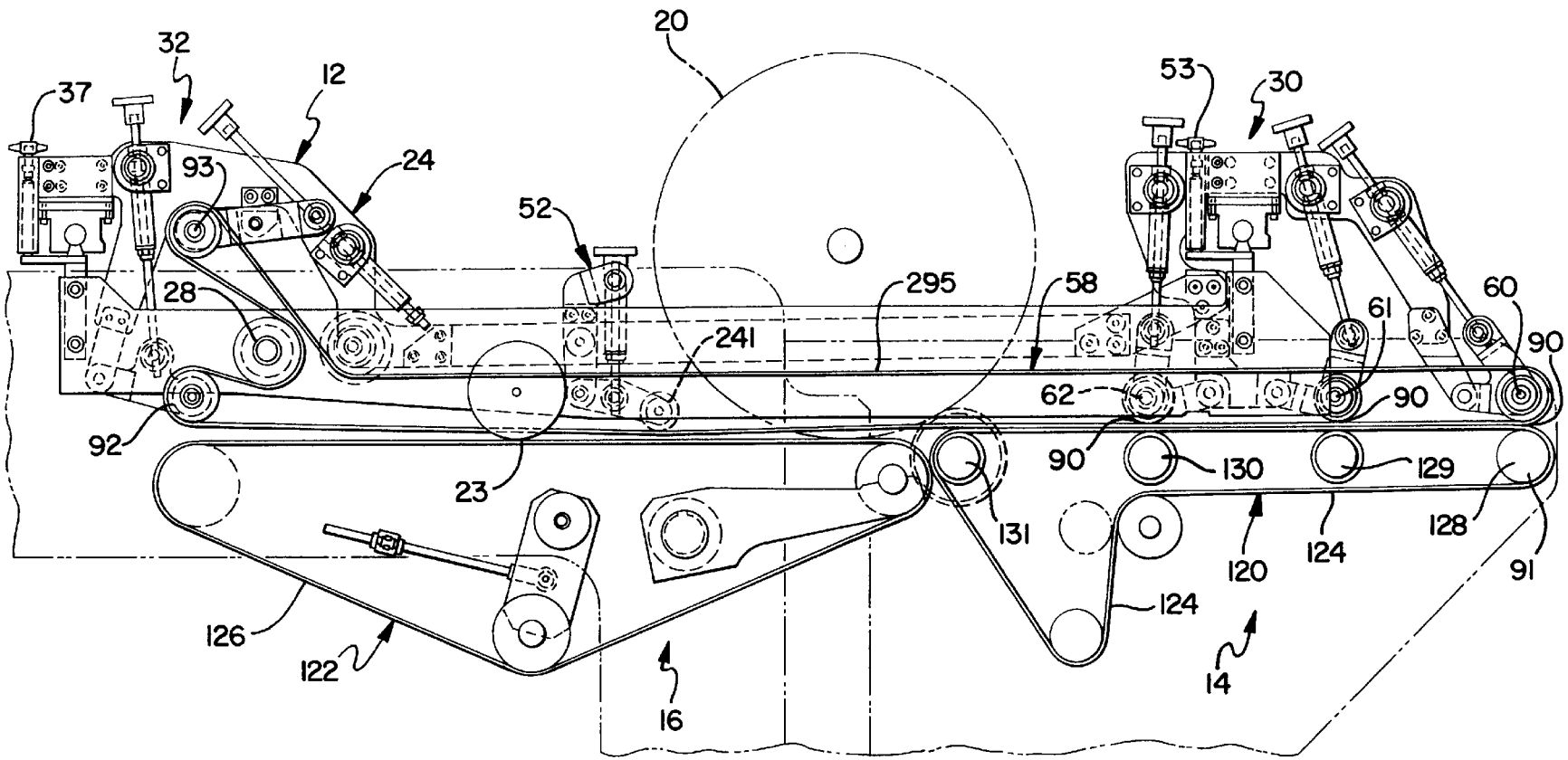
FIG. 2 is a side view of the delivery system of FIG. 1 (shown reversed from FIG. 1)

The top belt system 12, performs the following tasks: pulls and accelerates the product from the cutting module 22; holds the product in a controlled state while traveling through the top belt section of the delivery system; and guides the product into a stop wheel nip 23. Referring to FIG. 2, the top belt system 12 may include one or more top belt assemblies 24 for each product stream. The number and placement of the top belt assemblies 24 depends on the product configuration. It is a valuable asset to be able to move the top belt assemblies 24 across the product path during machine set-up (make-ready) or while running without slowing or stopping the delivery system, and without having to re-adjust individual belt pulleys and other controlling hardware.

Figure 3:
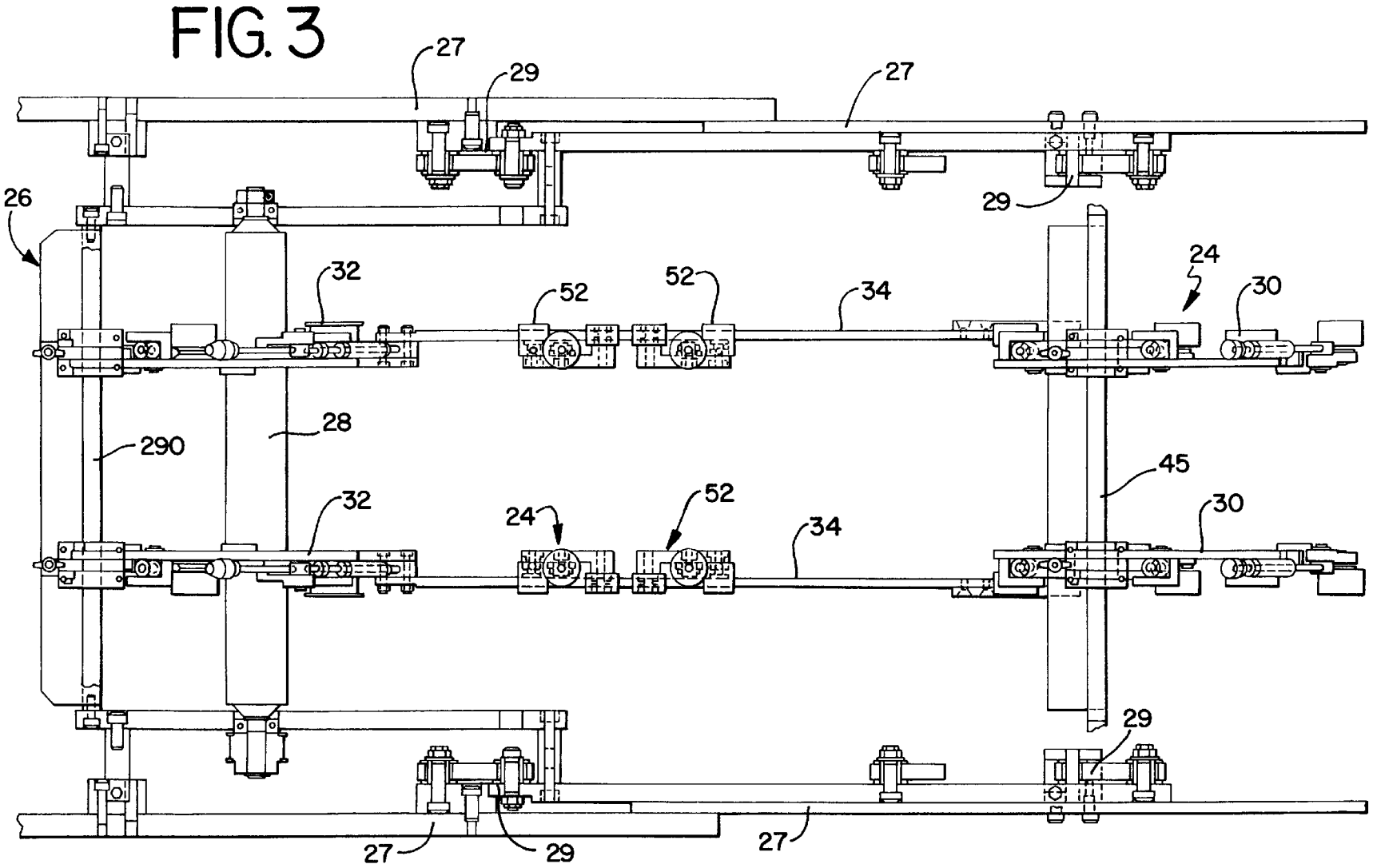
FIG. 3 is a plan view of the delivery system of FIG. 2.

Referring to FIG. 3, each of the top belt assemblies 24 are supported on a structure called a carriage 26. The carriage 26 is located above the product path and is linked to the frames 27 with connecting linkage 29. The carriage 26 can be quickly raised and lowered as an entire unit to clear product jams during operation. The carriage 26 also provides support for a common drive roller 28, which drives all the top belts. Each top belt assembly 24 preferably includes a front assembly 30 and a rear assembly 32 rigidly connected together with a connecting bar 34.

Figure 4:
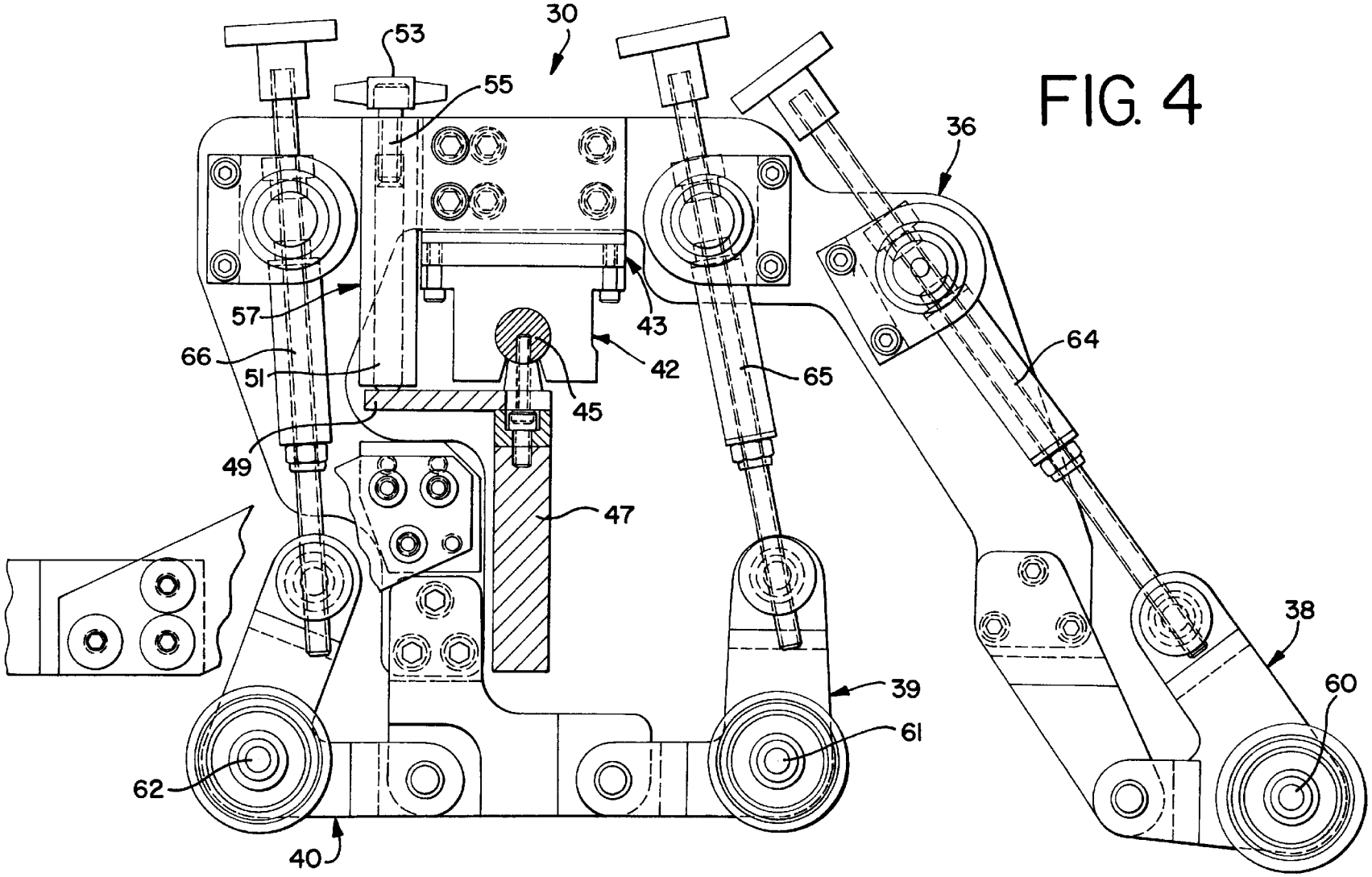
FIG. 4 is a side view of the front assembly of the top belt assembly of the delivery system of FIG. 2.

Referring to FIG. 4, the front assembly 30, includes a supporting frame 36, idler roller assemblies 38, 39, 40, and a supporting linear bearing block 42 which is connected to the carriage 26, and a bearing bracket 43 which connects the bearing block 42 to the supporting frame 36. The front assembly 30 is supported and guided by linear bearing shaft 45. The bearing shaft 45 is supported at stages along its length by a carrier cross-brace 47. A stop plate 49 is positioned between the shaft 45 and cross-brace 47 and interfaces with stop pin 51. The stop pin 51 may be locked and unlocked by hand using stop knob 53 and screw 55. The stop pin 51 and screw 55 are received in an opening formed through stop bracket 57. The stop bracket 57 is fixed to bearing bracket 43.

Figure 5:
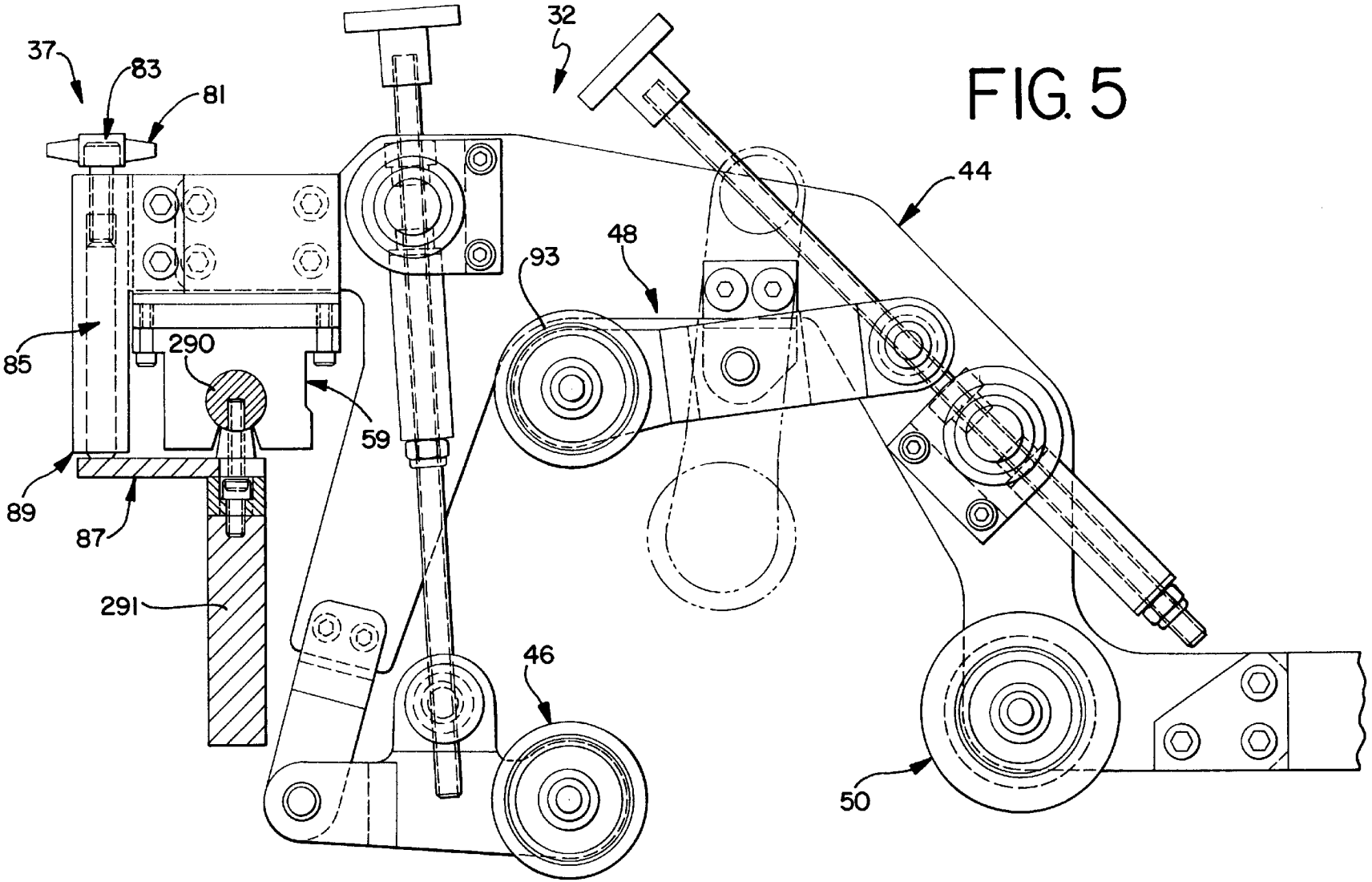
FIG. 5 is a side view of the rear assembly of the top belt assembly of the delivery system of FIG. 2.
Figure 6:
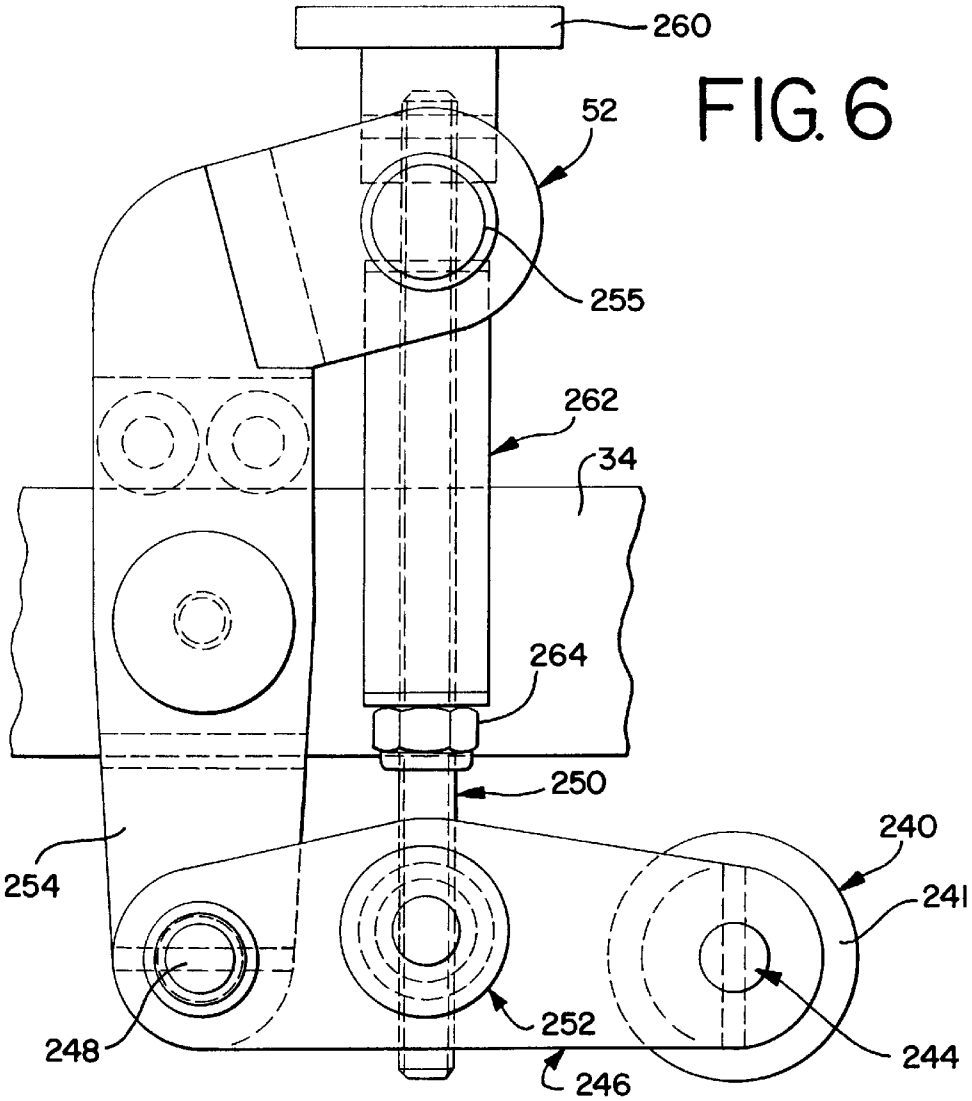
FIG. 6 is a side view of the auxiliary idler roller assembly of the delivery system of FIG. 2.

Referring to FIG. 5, the rear assembly 32, includes a supporting frame 44, idler roller assembly 46, take-up roller assembly 48 and fixed idler roller 50, and a supporting linear bearing/bracket 59 with a locking provision 37 similar to the front assembly 30, and includes knob 81, screw 83, pin 85, plate 87, and stop bracket 89. The rear assembly 32 is supported and guided by linear bearing shaft 290, which is a carrier cross-brace 291. The stop plate 87 is positioned between the shaft 290 and cross-brace 291, and interfaces with stop pin 83. Referring to FIG. 6, one or more auxiliary idler roller assemblies 52 may also be provided and supported on the connecting bar 34.

Each top belt assembly 24 can be moved across the product path ("side positioning") to the desired location by first hand-loosening the two locking knobs 53, 81, next moving the assembly 24 to the new location, and then hand-tightening the locking knobs 53, 81. Since the individual idler assemblies on the same top belt assembly are not changed relative to each other, no individual pulley adjustment is needed after this move. Side positioning can be done while running. Without this innovative construction, a typical belt move would require one or more individual pulley realignments, belt tension and contour re-adjustments, and the need to remove the belt from, and then put the belt back on its belt path; a procedure requiring hand tools and considerable time. Top belts 58 (shown in FIG. 2) may be replaced or removed from the top belts assemblies 24, without any disassembly and without using tools. Belt splicing or cutting is not required during removal or replacement. Accordingly, the operator may splice or purchase belts to specified length beforehand, and store them in a protected location near the delivery system for immediate use. Belts which are not needed for a particular product configuration may be quickly removed, stored, and reused. Damaged belts may be replaced with a minimum of downtime. It is also unnecessary to leave extra belts on the delivery system just to avoid belt replacement downtime, as these extra belts are exposed to operating forces and can be damaged or can interfere with production.

Figure 23:
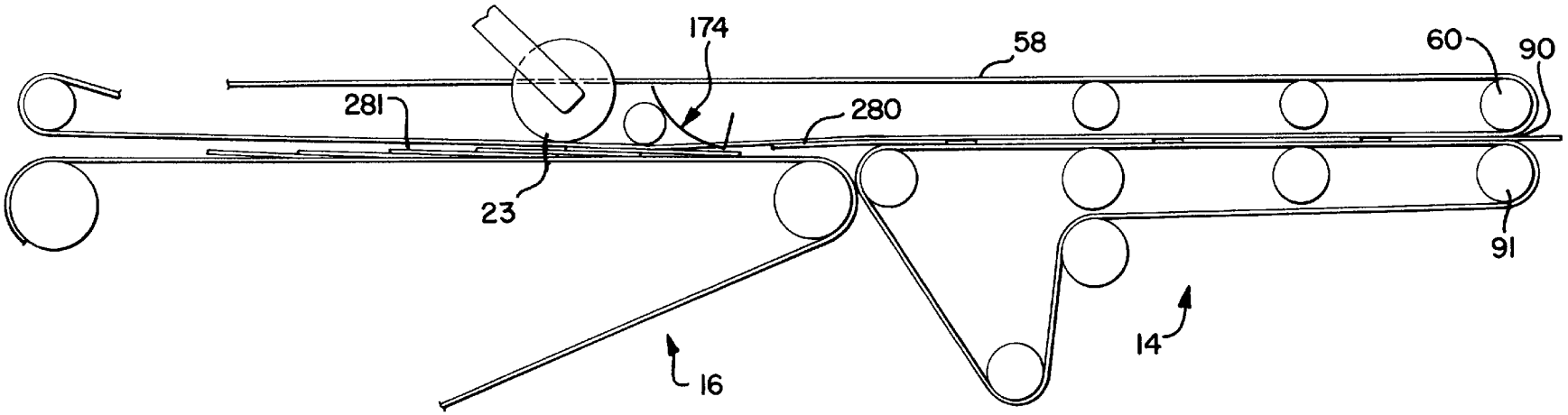
FIG. 23 is a schematic side view of product moving along a product path of the web-product delivery system.

Referring to FIG. 2, the top belt path includes the section directly over the product, the section wrapping the drive roller 28 and take-up roller 93 and return section 295. The return section 295, for the embodiment shown, for example, is about 3 inches above the product path. This configuration leaves ample space above the belt path for access by operators to make preparations and running adjustments. As shown in FIG. 23, each top belt path directly over the product 280 is independently controllable. A belt path height adjustment affects only the individual belt and has no affect on other belts in the system. This capability promotes maximum and independent control of products in each product stream. Where more than one belt 58 is used per product stream, each belt 58 may be adjusted to satisfy the control needs across that particular product path. The path of the section of the belt directly over the product is controlled with the adjustable idler rollers.

As shown in FIGS. 2, 4, and 23, three of these rollers 60, 61, 62 are part of the speed-up system 14, where the product first enters the delivery system and are part of individual adjustable top belt idler assemblies 38, 39, 40. Each of the top belt idler assemblies 38, 39, 40 allow for adjustable belt height and/or pressure on products, and a pre-set limiting pressure range determined with a load-biased threaded adjusting rods 64, 65, 66. The pre-loaded adjusting rods provide the following: avoidance of excessive belt pressure and easy attainment of desired pressure on the product; damage protection from product jams and foreign objects passing through the nip 90; and adjustment stability.

Figure 4C:
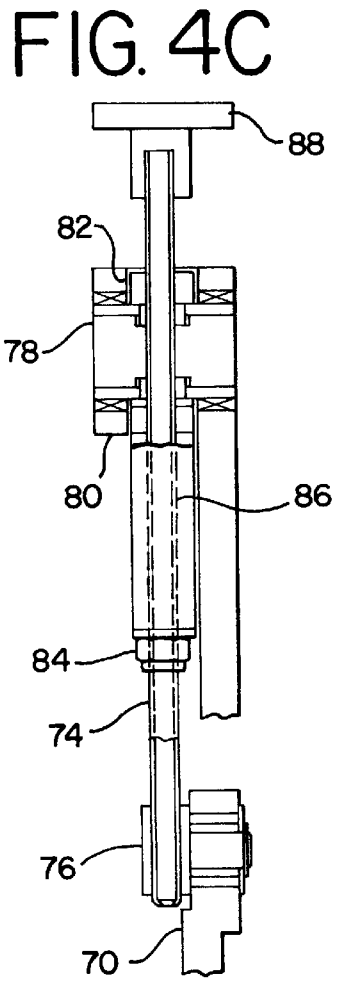
FIG. 4C is a sectional view taken through line C—C of FIG. 4A.
Figure 4B:
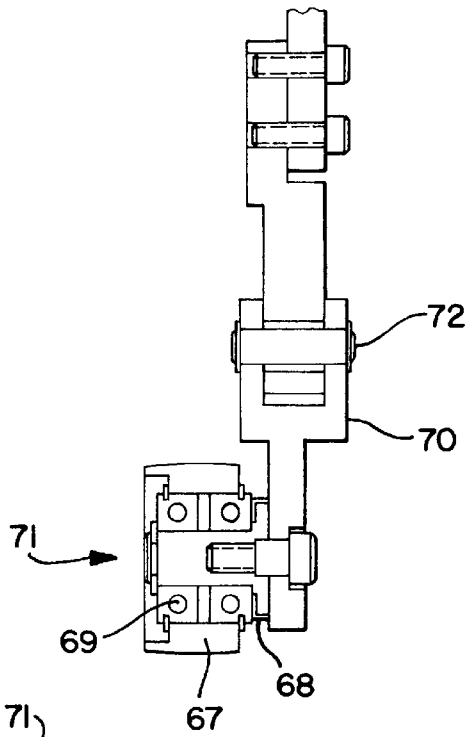
FIG. 4B is a sectional view taken through line B—B of FIG. 4A.
Figure 4A:
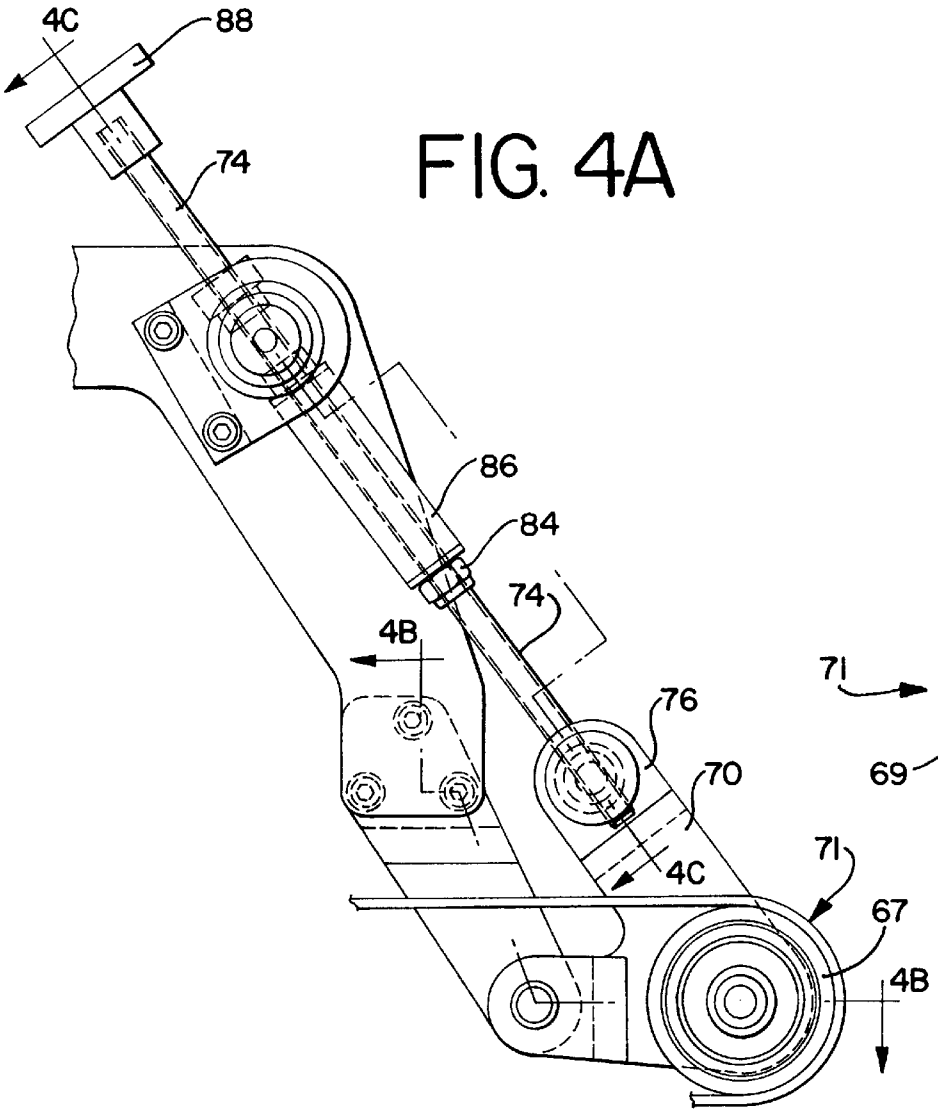
FIG. 4A is a side view of the front loading idler of the front assembly of the top roller system of FIG. 4.

For the embodiment shown, and with reference to the front loading idler assembly 38, of FIGS. 4A, 4B, 4C, each of the individual top belt idler roller assemblies 38, 39, 40 have the following fundamental adjustment configuration: a roller assembly 71 including roller 67, bearings 69 and a support/containment stud 68 which is mounted on a bracket 70 which is vertically pivotable about a fixed pivot pin 72, directly over the product path. The bracket position is controlled with a threaded adjusting rod 74 which threads into a bearinged pivot stud 76 mounted in the bracket 70. The roller 67 is movable along an arc in a vertical plane approximately horizontal to the fixed pivot pin 72. Therefore, the roller 67 can be moved vertically on or off the product path as the adjusting rod 74 is manually rotated. The other end of the adjusting rod 74 intersects a fixed bearinged pivot shaft 78, which is contained by a supporting bracket 80. Since the pivot shaft 78 is not thread engaged, the adjusting rod 74 is free to slide through the pivot shaft 78. The position of the adjusting rod 74 relative to the pivot shaft 78 is determined by a collar 82, which is locked to the adjusting rod 74, on one side of the pivot shaft 78, and a stop member 84 on the adjusting rod 74, which anchors a preloaded compression spring 86 which bears against the pivot shaft 78 on the other side of the pivot shaft 78. The amount of pre-load is determined by the location of the stop member 84. The stop member may include preferably any adjustable member or fastener, for example, an elastic stop nut, for the embodiment shown. The nut 84 is preferably wrench adjustable along the threaded portion of the adjusting rod 74. Therefore, the pre-loaded spring 86 is constantly trying to pull the adjusting rod 74 through the pivot shaft 78, and is prevented from doing so by the locked collar 82. This configuration provides a axially fixed adjustment rod position, relative to which the roller 67 can be moved and roller nip pressure established. A small knob 88 is located on the end of the adjusting rod 74. Fingertip rotation of the adjusting rod knob 88 determines roller position or pressure. The desired roller nip pressure or belt tensioning load can be pre-established by compressing the spring 86 with the elastic stop nut 84 to a pre-load which approximately matches the force created by the desired roller pressure acting in the opposing direction. Alternatively, a compression member, other than a compression spring could be adjusted to set the pre-load. In addition, a tension member set-up in a alternative configuration to perform the same function of the compression spring may be used. When the pre-load is exceeded by the roller pressure force, the spring 86 is additionally compressed allowing the adjusting rod 74 to slide an equal distance through the pivot shaft 78. This movement can be visually observed and tells the operator that the desired nip pressure or belt tension has been set. Although not recommended, additional roller pressure can be attained by rotating the adjusting rod 74 until the spring 86 is compressed to solid height; after which, further adjusting rod rotation becomes too stiff for finger adjustment. Additional pressure can also be attained by changing to a heavier spring which has a higher load deflection rate. It is advisable to operate with a heavier spring, for example, a Danly 9-1012-219, rather than a lighter spring compressed to solid height.

Setting the pre-load spring 86 to the normal pre-load range of about half its total deflection aids in protecting against jams. Wads of paper or foreign objects passing through the nip 90 (shown in FIG. 2), formed by one of the top belt idler rollers 60, 61, 62 and a bottom belt drive roller 128, 129, 130 will typically create a lifting force on the idler roller great enough to exceed the spring pre-load and permit the idler roller to raise high enough to avoid any damage from excessive force and to allow the wads or objects to continue through the system and reduce the likelihood of severe, production-stopping, product or foreign object jams. Adjustment stability is created by the consistent force on the pivot shaft 78 exerted by the pre-load spring 86. This force creates a torsional locking friction between the pivot shaft 78 and the adjusting rod 74, which effectively prevents unwanted adjustment changes caused by vibration. Therefore, the need for an inconvenient adjustment locking device is avoided.

Referring to FIGS. 2 and 3, two adjusting idler roller assemblies, the rear assembly 32 and auxiliary idler roller assemblies 52 are part of the first stage slow-down system 16. The last top belt control point is at roller 92 and it has all of the capabilities of the front loading idler assembly 38, mentioned above, but is typically adjusted for belt height position only. At this point, as shown in FIG. 23, the product is shingled 281 and traveling much slower than the top belt 58, so that the pressured belt contact would upset product travel. The auxiliary idler roller 241 is part of a unique auxiliary idler roller assembly 52, which has all of the capabilities mentioned above. The auxiliary idler roller assembly 52 mounts on the connecting bar 34, which is a part of the top belt assembly 24 at any location along the bar 34. Therefore, this auxiliary idler roller assembly 52 may be positioned forward or backward over the product path anywhere between the front assembly 30, and rear assembly 32. Referring to FIG. 23, this includes the part of the product path where the product 280 transitions from a separated progression of the products to a shingled product stream 281, at the first stage slow-down system 16. Typically, the auxiliary idler roller assembly 52 is positioned immediately ahead of the stop wheel nips 23 where the product is slowed to first stage slow-down belt speed. The height of the top belt 58 over the product, in this critical area, can be precisely controlled to help direct the leading edge of the product into the stop wheel nips 23 and to minimize the tendency of the product to buckle. Alternately, the auxiliary idler roller assembly 52 may be positioned near the transition wheel assembly 20 for top belt height control, which contributes, to product shingling consistency. These auxiliary roller assemblies 52 can be easily moved from one top belt assembly bar 34 to another, removed entirely, reverse mounted, or mounted in tandem depending on the top belt configuration required.

Figure 5B:
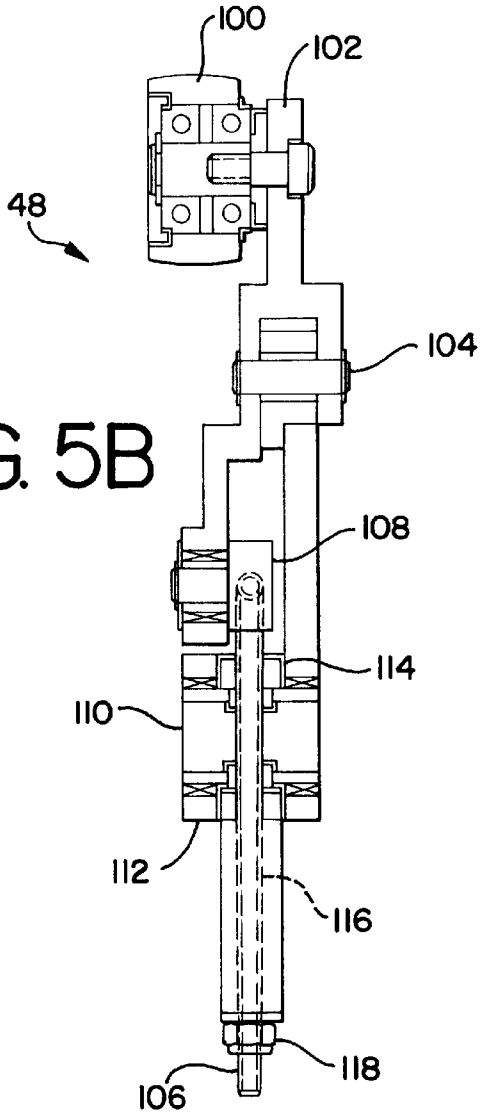
Figure 5A:
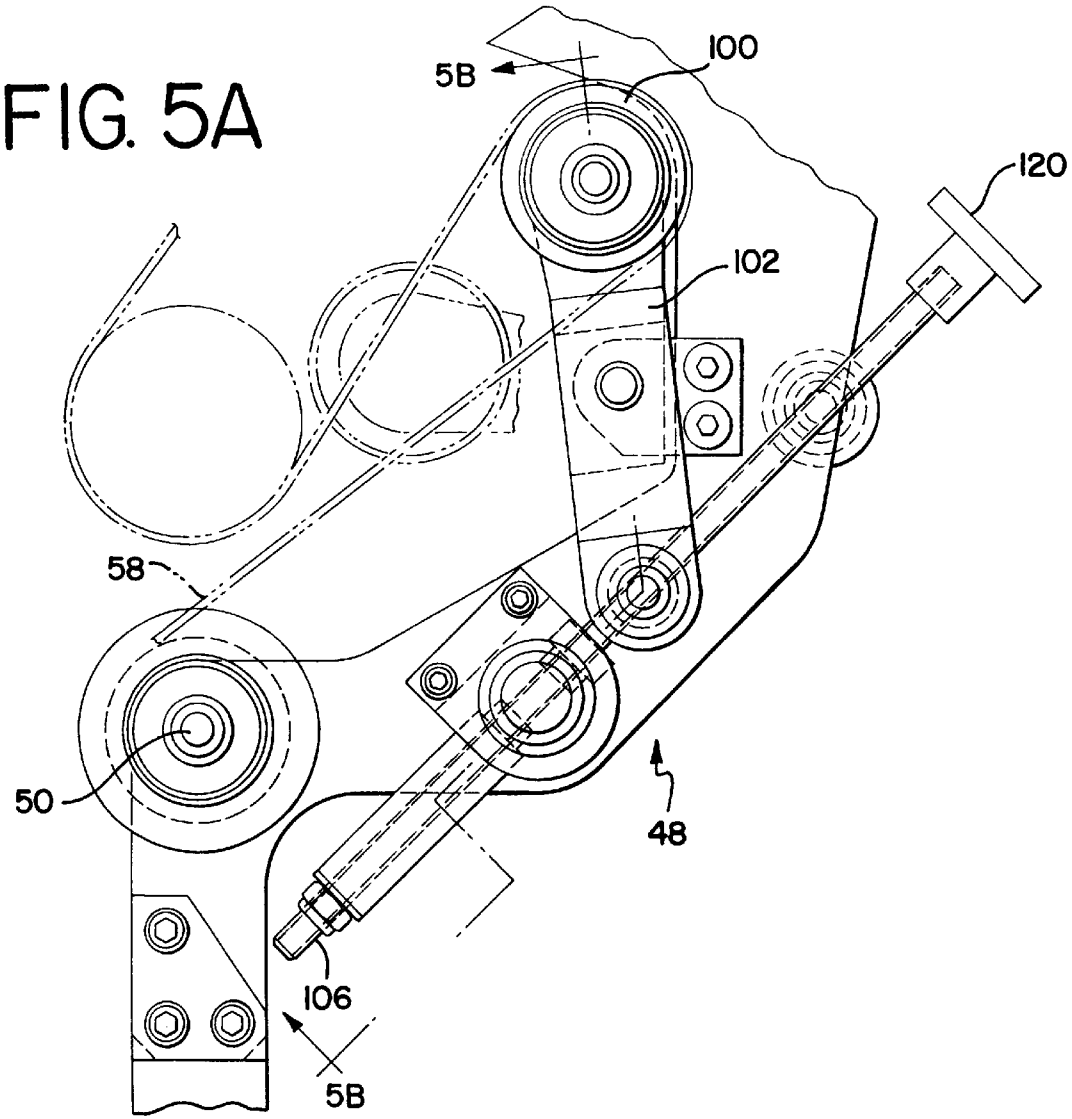

Referring to FIGS. 5A, 5B, each top belt has its own belt tensioning device called a belt take-up assembly 48. The basic configuration is similar to that of the individual belt idler roller assemblies: roller 100 is mounted on a vertically rotatable lever 102, pivotable about a fixed pin 104, which is rotationally controlled by a threaded adjusting rod 106. The adjusting rod 106 is threaded through a bearinged pivot stud 108, mounted on the lever 102, and passes through a fixed bearinged pivot shaft 110, which is contained by a supporting bracket 112. The adjusting rod 106 is not threaded in the pivot shaft 110 and is free to slide through the pivot shaft 110; however, the position of the adjusting rod 106 relative to the pivot shaft 110 is determined by a collar 114, which is locked to the adjusting rod 106 on one side of the pivot shaft 110. A pre-loaded compression spring 116 bears against the pivot shaft 110 on the other side. The amount of pre-load is determined by an stop member 118 (preferably, an elastic stop nut) on the adjusting rod 106, which anchors the end of the spring 116 away from the pivot shaft 110 to the adjusting rod 106. The nut 118 is preferably wrench adjustable along a threaded portion of the adjusting rod 106. Therefore, the pre-load spring 116, is constantly trying to pull the adjusting rod 106 through the pivot shaft 110, and is prevented from doing so by the locked collar 114. This configuration provides a fixed adjustment rod position relative to which the take-up roller 100, can be moved and belt tension can be set. A small knob 120 is located on the end of the adjusting rod 106. Fingertip rotation of the adjusting rod knob determines roller position and resulting belt tension. The desired belt pre-load tension can be pre-established by compressing the spring 116 by rotating the elastic stop nut 118 along the adjusting rod 106 to a pre-load which approximately matches the force created by the desired belt tension as determined by the belt take-up roller 100, acting in the opposing direction. When the pre-load is exceeded by the belt tension, the spring 116 is additionally compressed allowing the adjusting rod 106 to slide an equal distance through the pivot shaft 110. This movement can be visually observed which tells the operator that the desired belt pre-load tension has been set. Although not recommended, additional tension can be attained by rotating the adjusting rod 106 until the spring 116 is compressed to solid height; after which, further adjusting rod rotation becomes too stiff for finger adjustment. Additional tension can also be attained by changing to a heavier spring, for example, a Danly 9-1012-210, which has a higher load deflection rate. Use of a heavier spring is a better alternative than operating with the lighter spring compressed to solid height. Preferably, the pre-load range is set at about half its total deflection to provide protection from jams. Wads of paper or foreign objects passing under the top belt 58 or between the top belt 58 and the top belt pulleys 60, 61, 62 will typically create a belt tension great enough to exceed the pre-load and permit the take-up roller lever 102 to rotate and move the take-up roller 100 enough to avoid any damage from excessive tension and to allow the wads or objects to continue through the system and reduce the likelihood of severe, production-stopping, product jams.

Adjustment stability is created by the consistent force on the pivot shaft 110 exerted by the pre-load spring 116. This force creates a torsional locking friction between the pivot shaft 110 and the adjusting rod 106, which effectively prevents unwanted adjustment changes caused by vibration. Therefore, the need for an inconvenient adjustment locking device is avoided. Belt removal and replacement is also simplified. Belt tension can be relieved by moving the take-up roller 100, away from the belt-wrapped side by rotating the take-up roller 100 lever by hand. Enough belt slack can be created so that the belt can be easily removed. Remounting requires that the belt be placed in its correct belt path except for one roller, and then belt slack may be attained by rotating the take-up roller 100. The belt 58 can then be placed around the last roller and the tension re-applied by allowing the take-up roller 100 to automatically return to its normal operating position previously set. If an older belt, which has been elongated considerably, is replaced with a new shorter belt, the take-up roller 100 should be adjusted to re-establish the correct compression spring load. Height and pressure adjustments to other belt rollers along the belt path have almost no affect on the belt tension because the belt path geometry is such that the belt path length is almost unchanged. Also, the belt take-up compression spring 116, can change compression length enough to compensate for small path length changes without changing belt tension appreciably.

Figure 7:
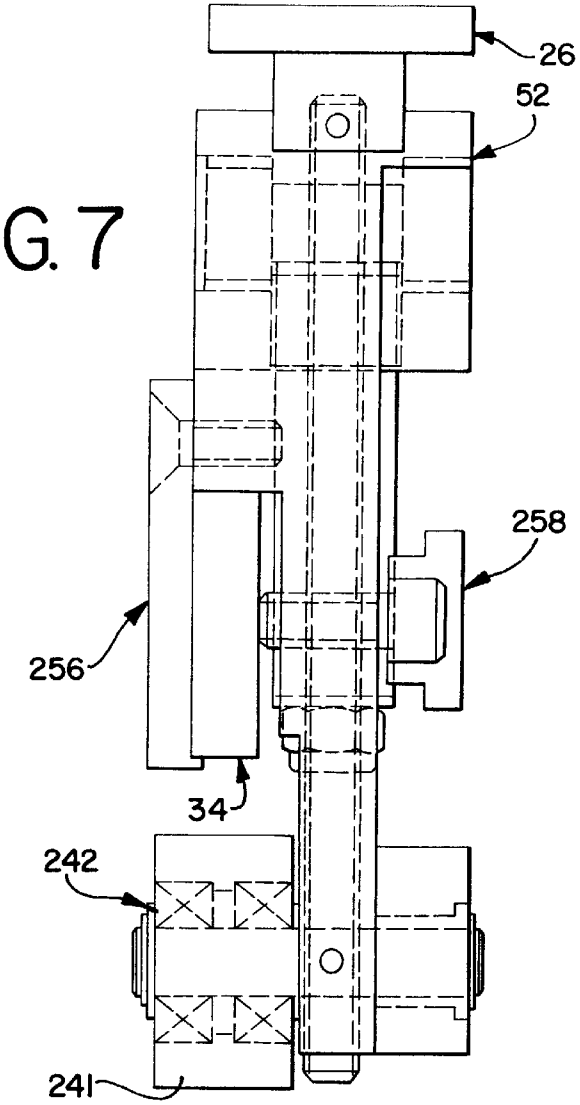
FIG. 7 is an end view of the auxiliary idler roller assembly of FIG. 6.

Referring to FIGS. 6 and 7, the auxiliary roller assembly 52 includes a roller assembly 240 including a roller 241, bearings 242, shaft 244, arm 246, pivot pin 248, support bracket 254, fixed bearinged pivot shaft 255, clamping block 256, clamp knob and screw 258, adjusting rod 250, stud 252, adjusting knob 260, spring 262, and stop member 264. The stop member may include, for example, an elastic nut, as shown. Alternatively, the spring 262 may include any other conventional compression member to provide the pre-load on the adjusting rod 250. The roller assembly 240 is rotatably attached to arm 246. The arm 246 is vertically pivotable about fixed pivot pin 248 directly over the belt 58 or product path. The pivot pin 248 mounts to support bracket 254. Clamping block 256 is attached to the support bracket 254. Screw 258 passes through bracket 254 and clamps the bar 34 against block 256. The pivot shaft 255 is contained by the bracket 254. The adjusting rod 250 is not threaded in the pivot shaft 255 and is free to slide through the pivot shaft 255. A user may unscrew the clamp knob and screw 258 to un-clamp the auxiliary roller assembly 52, from the bar 34. The vertical position of the roller 241 may be set by rotating the adjusting knob 260 to rotate the rod 250, which is engaged in bearinged stud 252. On top end, the knob 260 prevents the spring 262 from pulling the rod 250 through the pivot shaft 255. On the bottom end, the bearinged stud 252 includes a threaded hole to receive the threaded adjusting rod 250 to allow the arm 246 to rotate in a vertical plane. The spring 262 applies a load to stabilize the roller position and provide relief from product jams.

Figure 8:
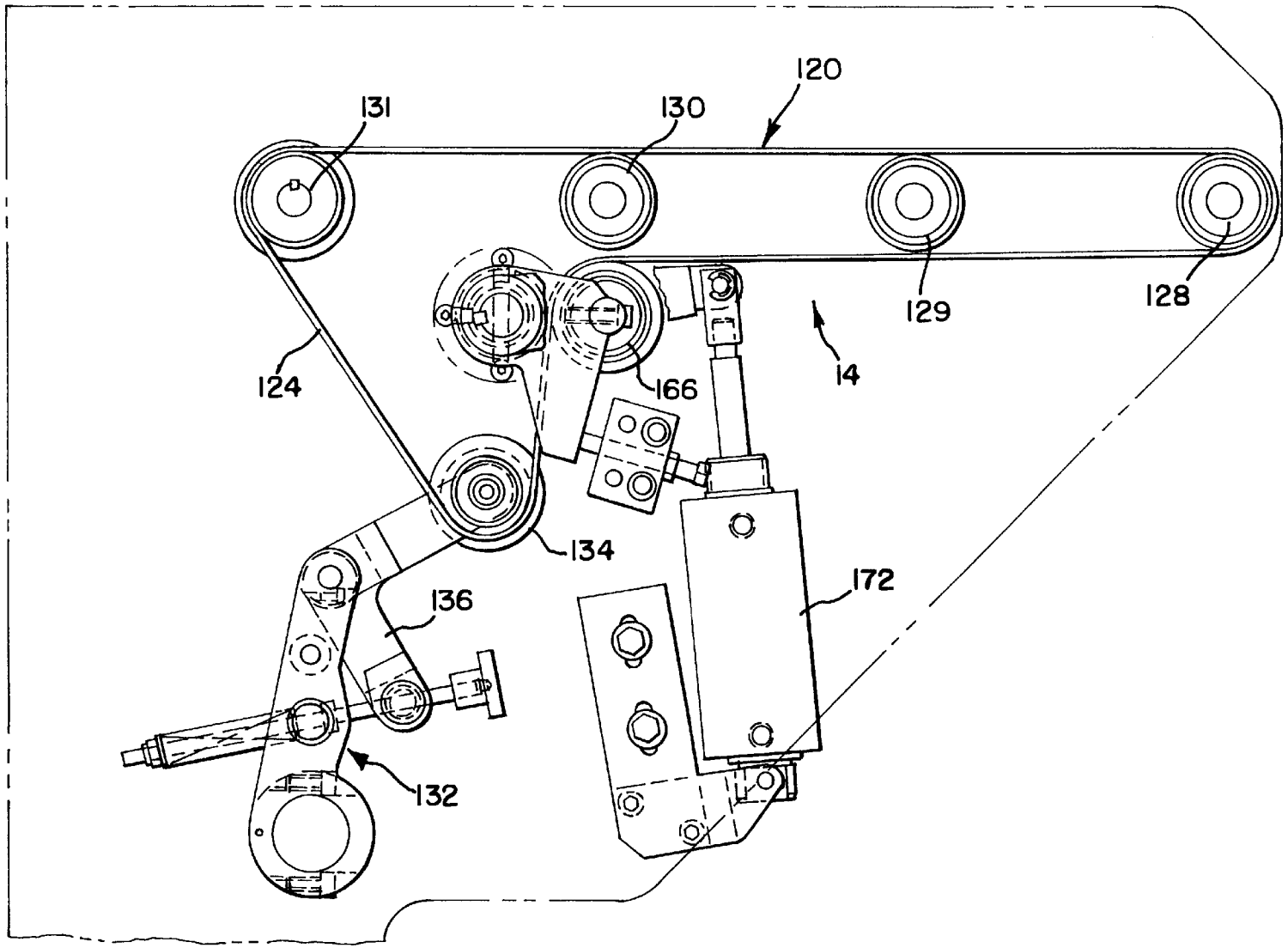
FIG. 8 is a side view of the bottom belt throw-off assemblies of the speed-up system of the delivery system of FIG. 2.
Figure 13:
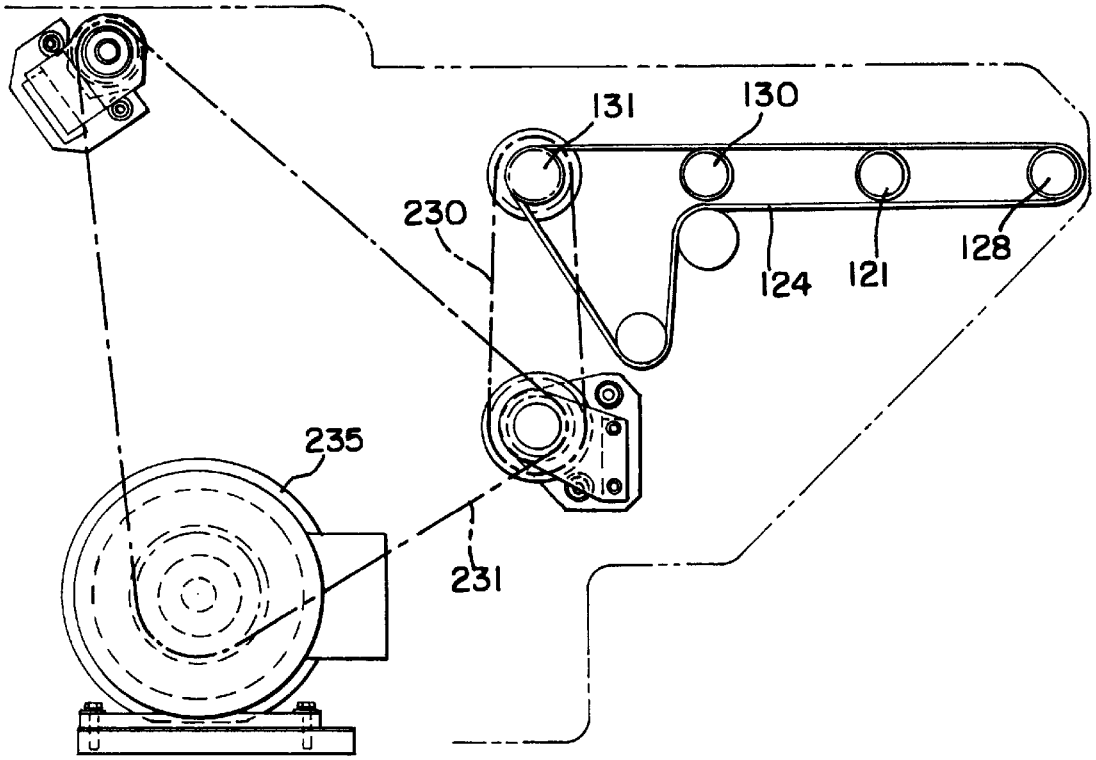
FIG. 13 is a side view of the timing belt drive arrangements.
Figure 14:
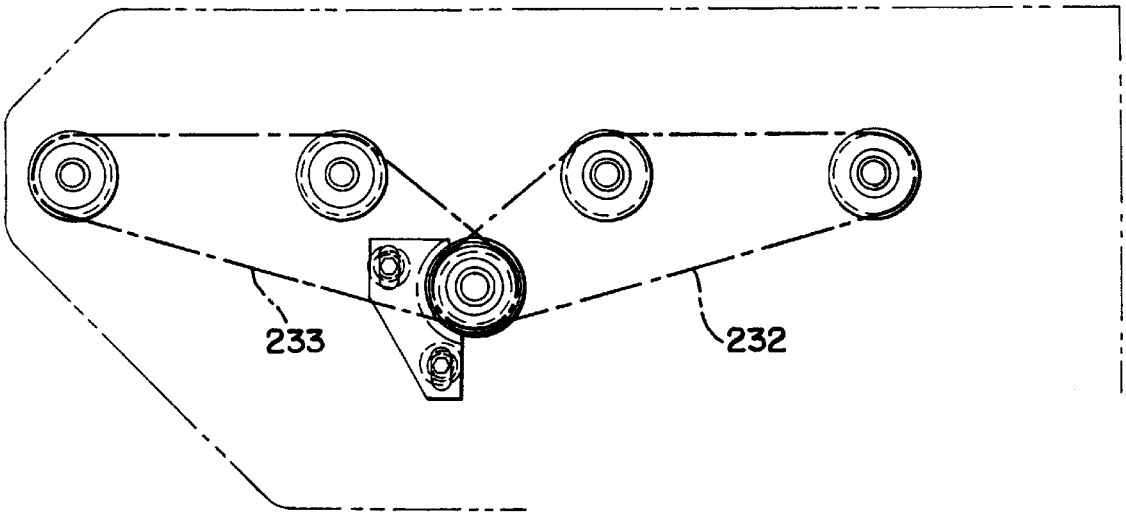
FIG. 14 is a side view showing the timing belts drive arrangement to the speed-up system.
Figure 15:
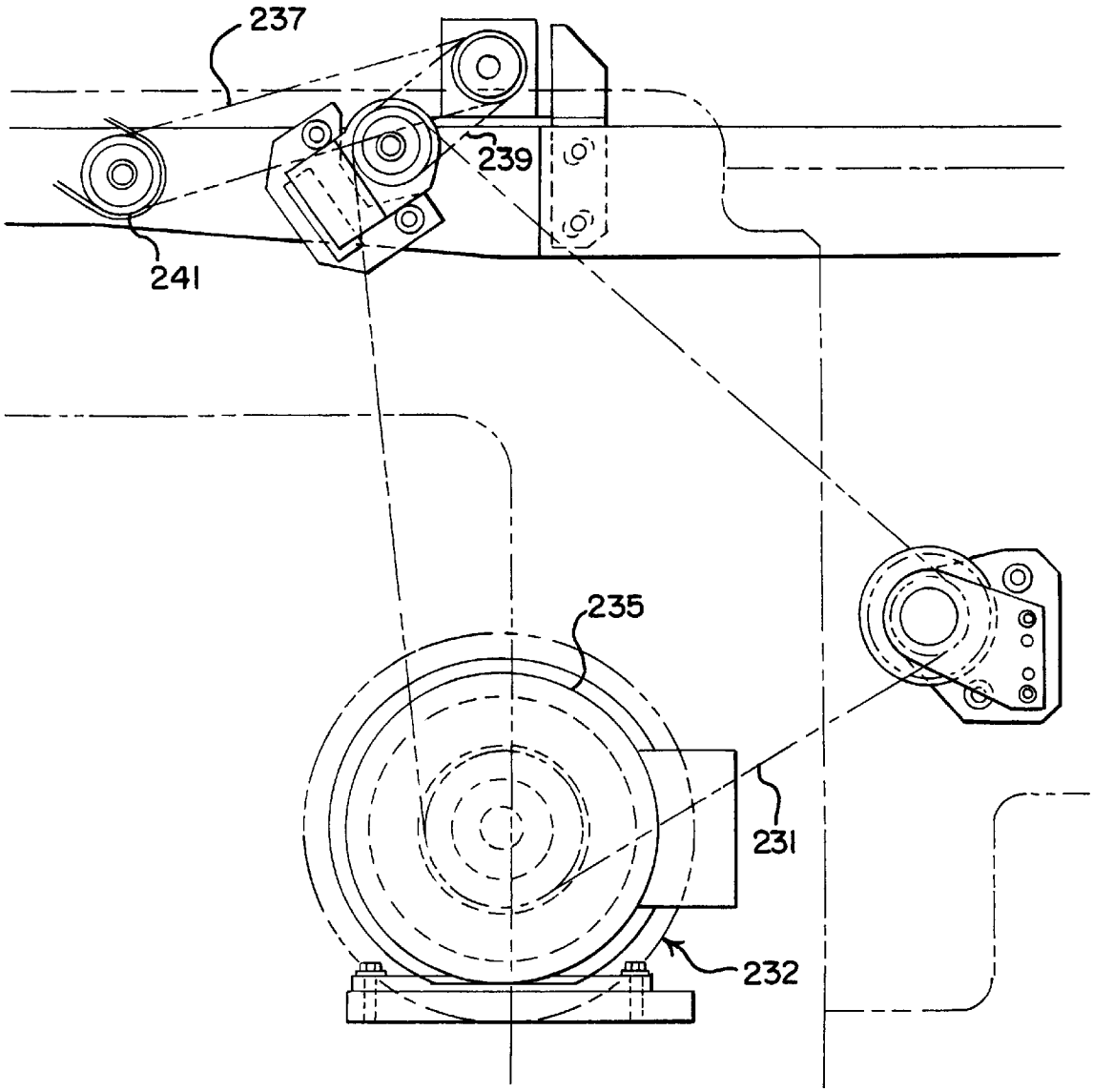
FIG. 15 is a side view of the timing belt arrangement for top belt system.

Bottom belt systems which include the speed-up system 14, are an integral part of the delivery system 10. Referring to FIGS. 2 and 8, the speed-up system 14 includes one or more speed-up assemblies 120, which pull and accelerate the product from the cutting unit; and transport the product through the speed-up system 14. Each of the speed-up system assemblies 120 include bottom belt 124, which is driven by four belt drive rollers 128, 129, 130, 131, which provide support across all the product and belt paths. Referring to FIGS. 13–15, these rollers 128–131 are positively driven via timing belts 230, 231, 232, 233, and a drive motor 235. The top belt system drive roller 241 driven by timing belts 231, 237, 239. Electronic controls provide control of the surface speed of the belts and drive rollers 128–131, so that some speed-up of the product can be obtained. This speed-up provides some product separation, which can be varied by the amount of speed-up set by the operator. In conjunction with the top belt idler rollers 60, 61, 62, located over the three leading bottom belt rollers 128, 129, 130, a multitude of pulling nip points and/or envelope containment points 90, can be utilized to give a superior degree of product control through the speed-up system, which is a capability directly attributable to the three driven bottom belt rollers 128–130.

Figure 12:
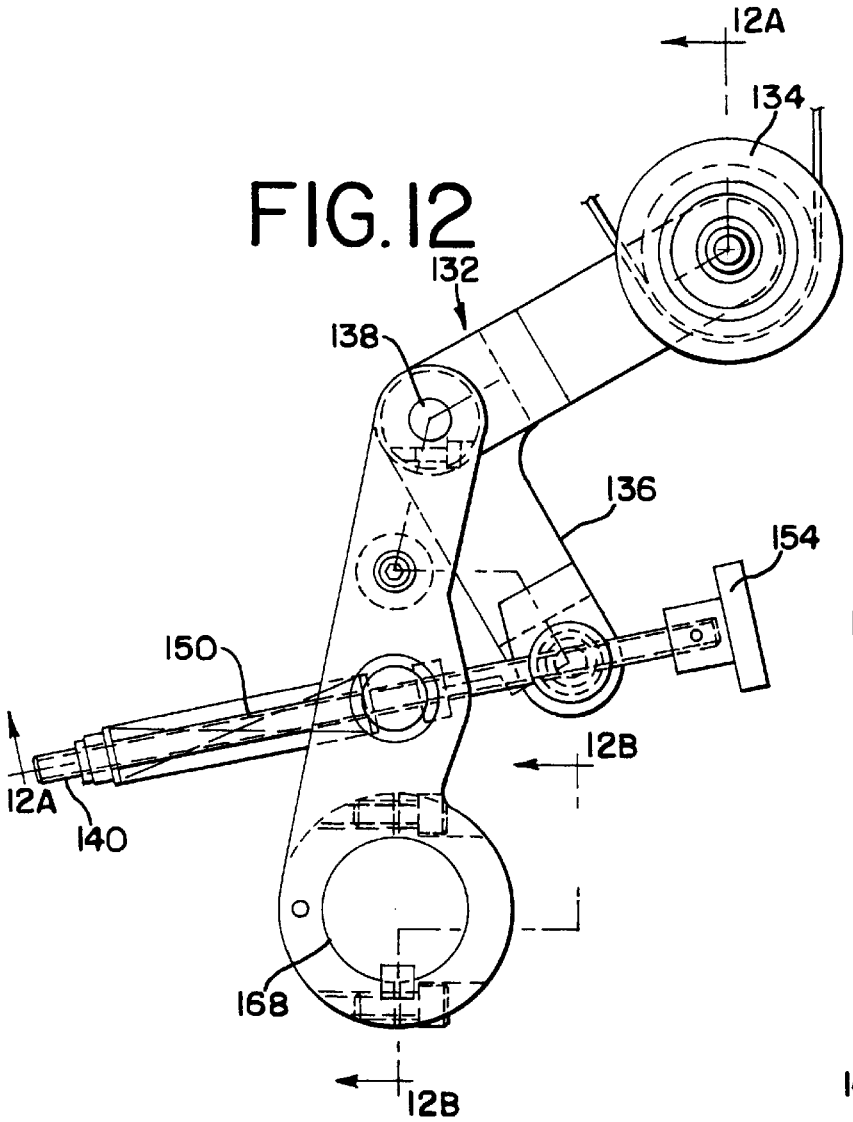
FIG. 12 is a side view of the bottom belt take-up assembly of FIG. 8.
Figure 12A:
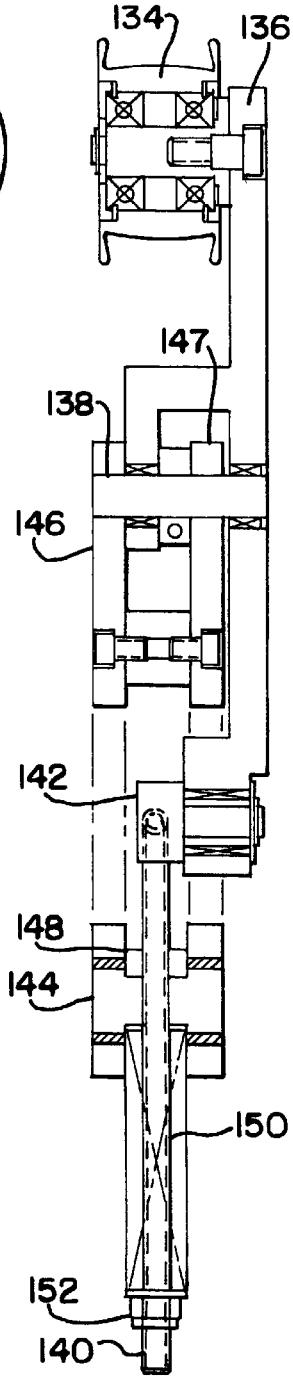
FIG. 12A is an sectional view taken through line A—A of FIG. 12.
Figure 12B:
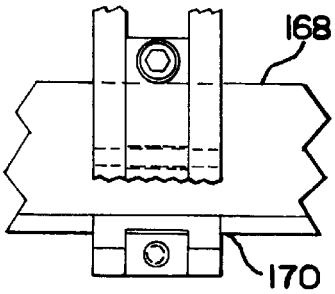
FIG. 12B is an sectional view taken through line B—B of FIG. 12.

As shown in FIGS. 12, 12A, 12B, the configuration of the individual bottom belt take-up idler roller assembly 132, is similar to the individual top belt take-up assembly, and includes the following features. A roller 134 is mounted on a vertically rotatable lever 136, pivotable about a fixed dowel pin 138, which is rotationally controlled by threaded adjusting rod 140. The adjusting rod 140 is threaded through a bearinged pivot stud 142, mounted on the lever 136, and passes through a fixed bearinged pivot shaft 144, which is mounted between two supporting plates 146, 147. The adjusting rod 140 is not threaded in the pivot shaft 144 and is free to slide through the pivot shaft 144. However, the position of the adjusting rod 140 relative to the pivot shaft 144, is determined by a collar 148 locked to the adjusting rod 140 on one side of the pivot shaft 144, and a pre-loaded compression spring 150, which bears against the pivot shaft 144 on the other side. The amount of pre-load is determined by an stop member 152, (preferably, an elastic stop nut) on the adjusting rod 140, which anchors the end of the spring 150 away from the pivot shaft 144 to the adjusting rod 140. The stop nut 152 is preferably wrench adjustable. Therefore, the pre-load spring 150 is constantly trying to pull the adjusting rod 140 through the pivot shaft 144, and is prevented from doing so by the locked collar 148. This configuration provides a fixed adjustment rod position relative to which the take-up roller 134 can be moved and belt tension can be set. A small knob 154 is located on the end of the adjusting rod 140. Fingertip rotation of the adjusting rod knob 154 determines roller position and resulting belt tension. Advantageous features of this configuration which are similar to the top belt take-up configuration, and previously described in detail, are as follows: belt tension is pre-established and maintained; damage protection from jams and foreign objects; and adjustment stability. Belt removal and replacement and belt sideward positioning are also enhanced as is explained below.

Figure 11:
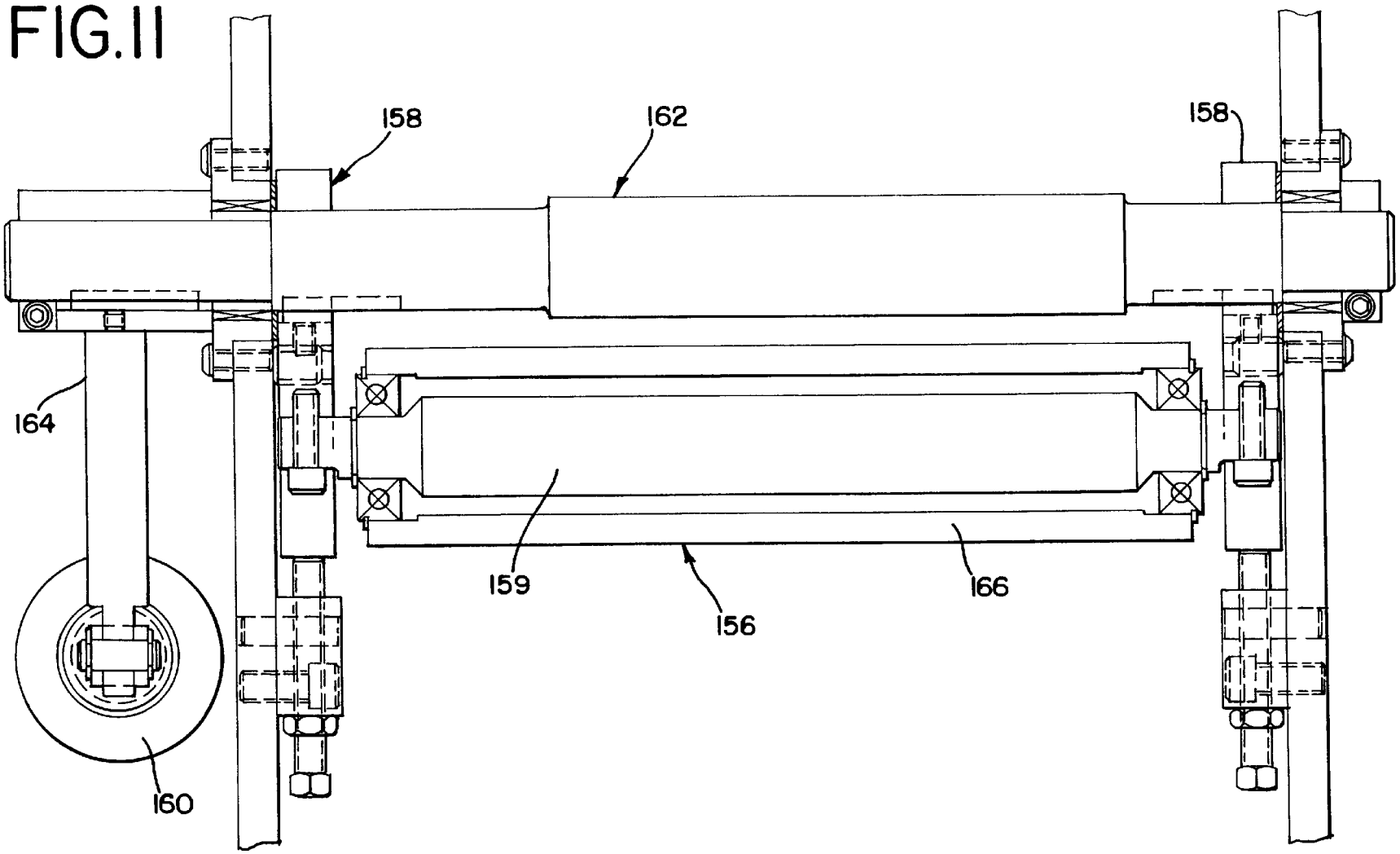
FIG. 11 is a plan view of the throw-off assembly of FIG. 8.

Referring to FIG. 11, the throw-off assembly includes a dead shaft roller assembly 156, spanning the delivery system 10. A shaft 159 is mounted on rotatable levers 158 actuated by a double acting air cylinder 160 via a throw-off or connecting shaft 162 and lever 164. A shaft roller called a throw-off roller 166, can be moved from its running position where the tensioned bottom belts wrap this roller to its throw-off position where the tensioned bottom belts are slackened. The advantages of this capability are as follows: belts and belt take-up assemblies can be moved easily across the product path by hand, while stationary or normally running, with the belts in a slackened condition.

Figure 9:
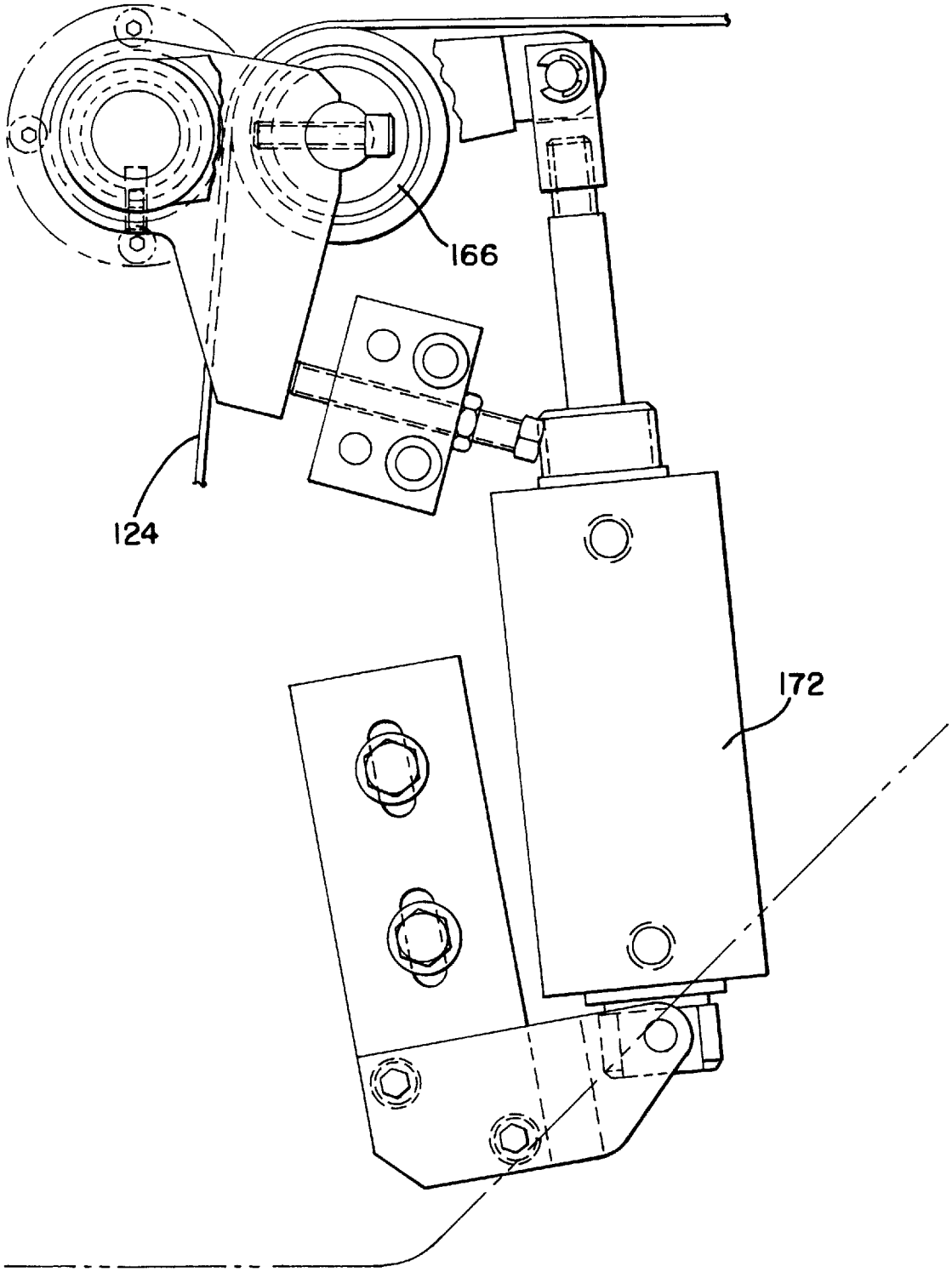
FIG. 9 is a side view of the throw-off assembly of FIG. 8 in the on-position.
Figure 10:
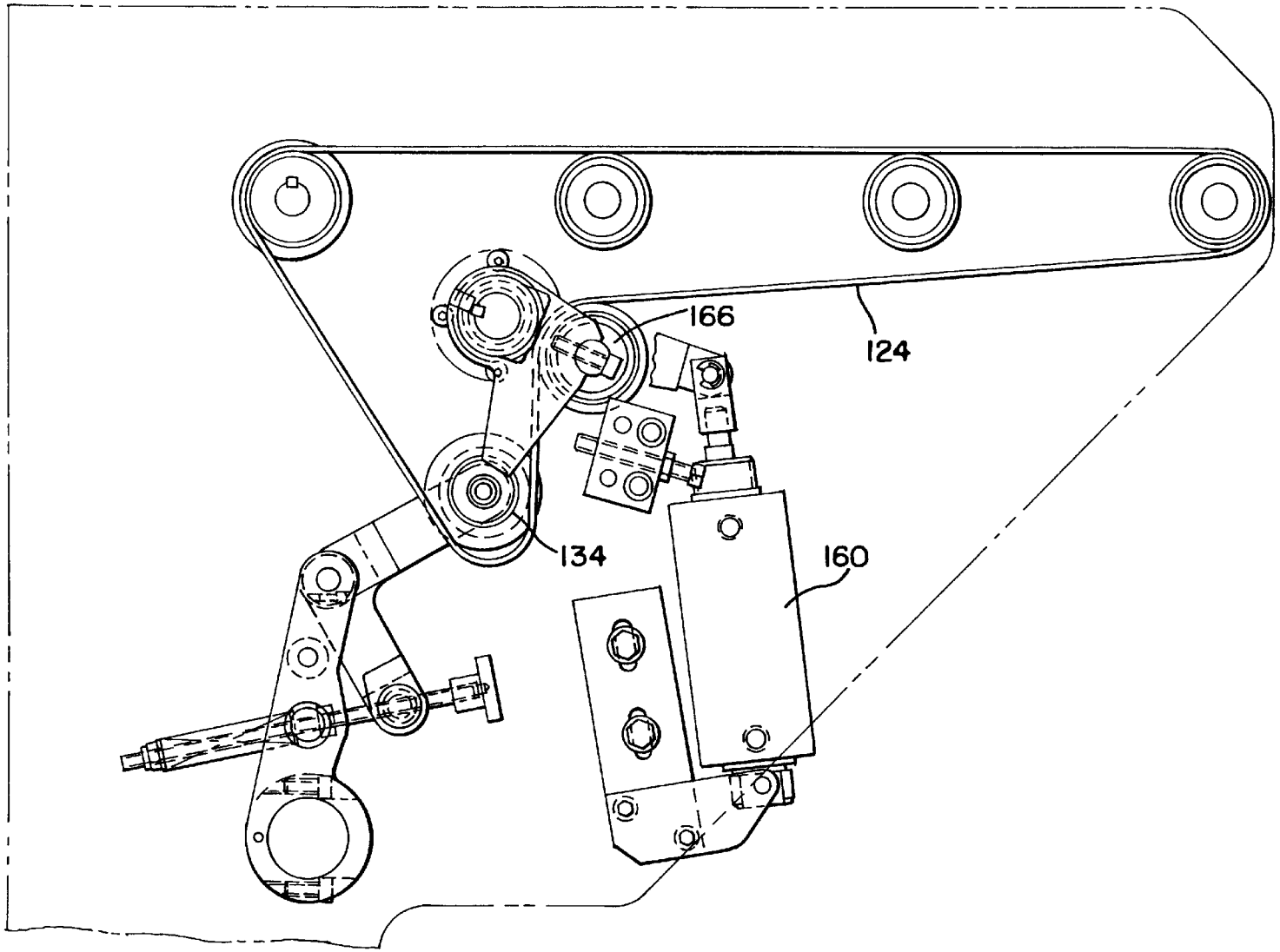
FIG. 10 is a side view of the throw-off assembly of FIG. 8 in the off-position.

Referring to FIGS. 12, 12A, 12B, the belt take-up assemblies mount on a support shaft 168 and are fixed with key 170 to the shaft 168, to maintain a common rotational position. Referring to FIGS. 9 and 10, when the bottom belts 124 are slackened, the frictional force resisting sideward movement of the take-up assemblies is greatly reduced, thus permitting sideward positioning. These moves can best be done while running the delivery system slowly during make-ready. Replacement of bottom belts 124 replacement requires that the existing belt be cut and removed, a new belt be cut to specified length, and spliced after being positioned in the correct belt path. After splicing, the belt 124 can easily be placed around the take-up roller 134 with the throw-off roller 166 in the thrown-off or slack-belt position, as shown in FIG. 10. Once the belt 124 and take-up roller 134 are in the desired sideway alignment location, the throw-off roller 166, can be actuated via air cylinder 172 and advanced to its normal belt tensioned running position, as shown in FIG. 9. Unless the new replacement belt length is greatly different than the replacement belt, no belt tensioning adjustment is needed.

Figure 16:
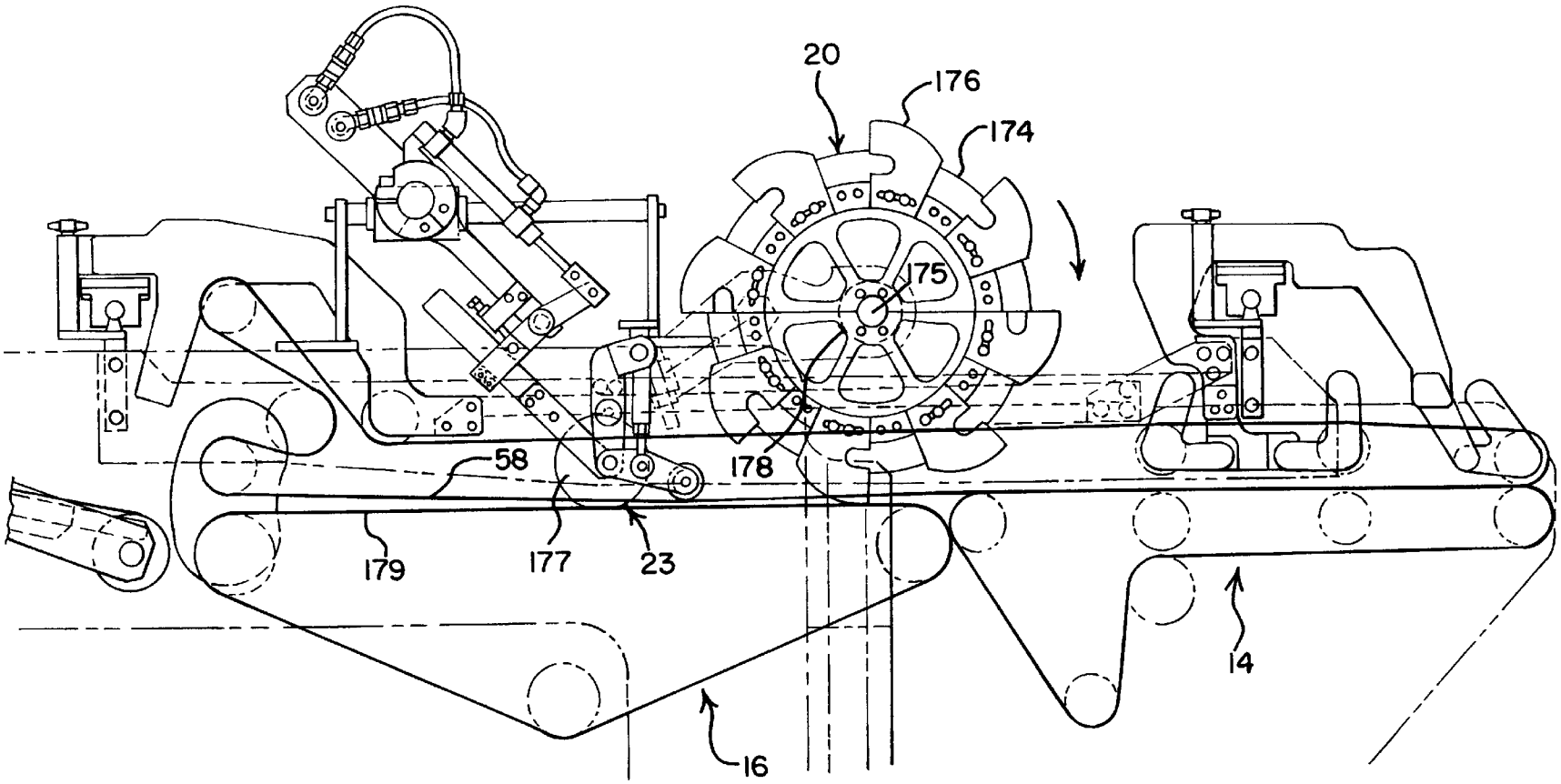
FIG. 16 is a side view of a preferred embodiment of the web-product delivery system.
Figures 18, 19:
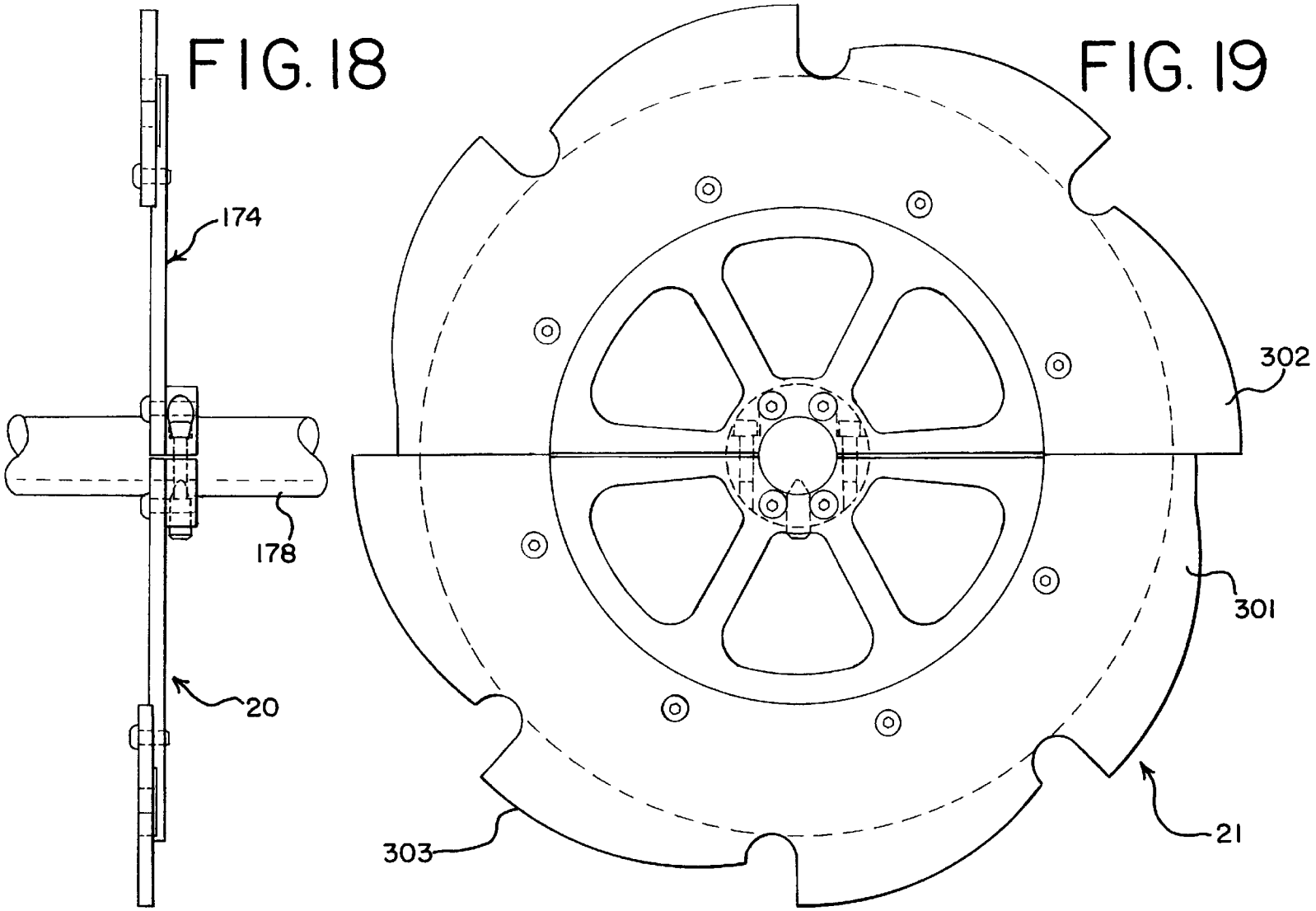
FIG. 18 is an end view of the transition wheel of FIG. 17.
FIG. 19 is an alternative preferred embodiment of the transition wheel assembly.

Referring to FIGS. 16 and 18, transition wheel assembly 20, provides vertical separation between consecutive products insuring that the faster following product will pass over the preceding product before being slowed by the first stage slow-down system, stop wheel nip 23. The product also drops vertically from the speed-up system 14 to the slightly lower first stage slow-down system 16. At slower operating speeds, this vertical separation between consecutive products can often be accomplished by gravity alone, but as operating speeds increase, additional product control, as provided by the cam-like curved surfaces 176 around the transition wheel periphery, is required. One or more transition wheel assemblies 20, mounted on a common axis of rotation 175, are needed for each product stream. One or more transition wheels 174 are mounted on a shaft 178, which crosses the delivery above the entry area of the first stage slow-down delivery belt. The shaft 178 is therefore positioned to support the wheels 174 in a vertical plane directly over the product streams and vertically adjustable so that the periphery of the wheel nearest the product path can be located to displace the product downward in accordance with the specific displacement requirement of the product.

Figure 20:
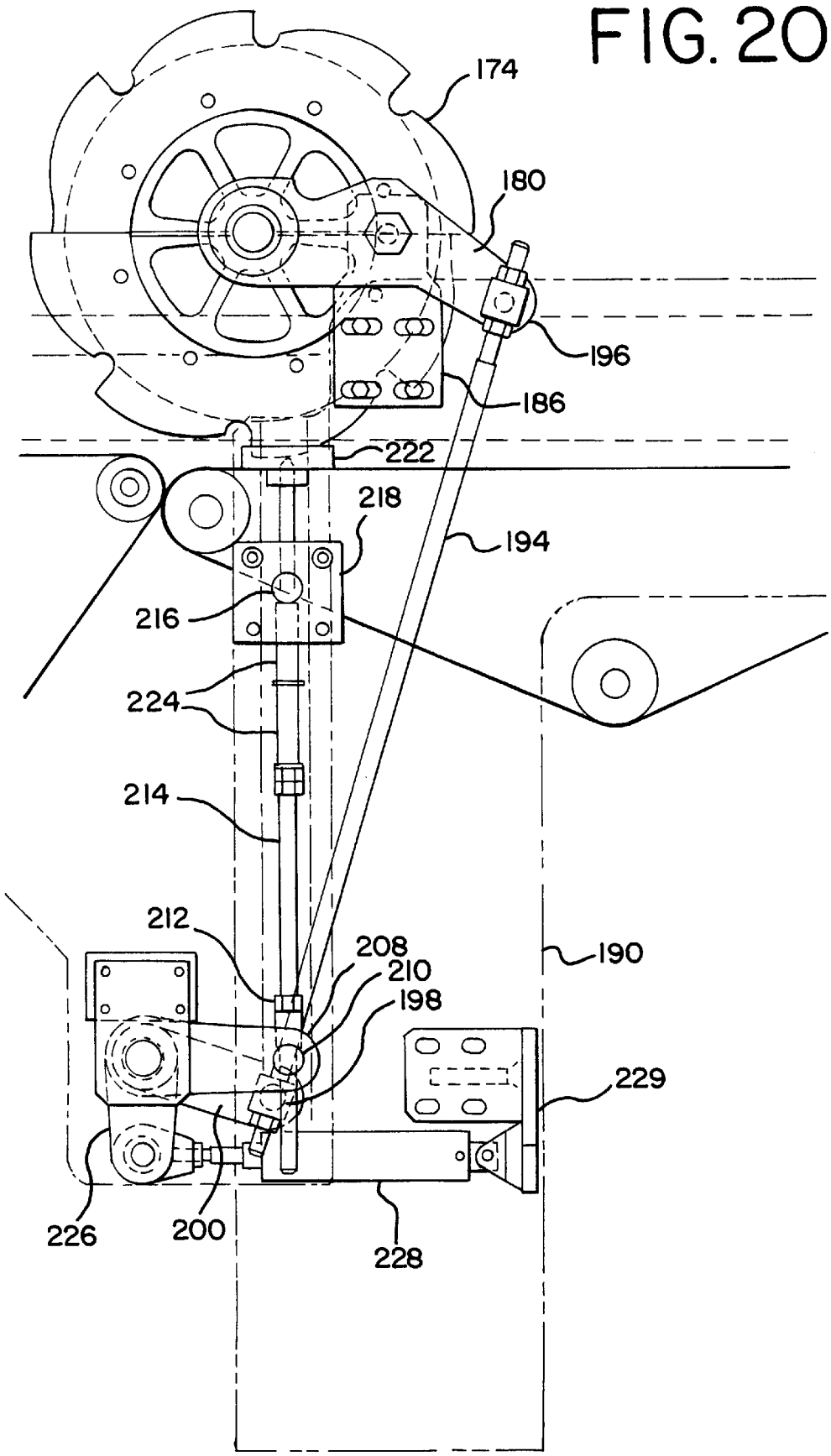
FIG. 20 is an side view of the operating side of the transition wheel assembly, throw-off and height adjustment system.
Figure 21:
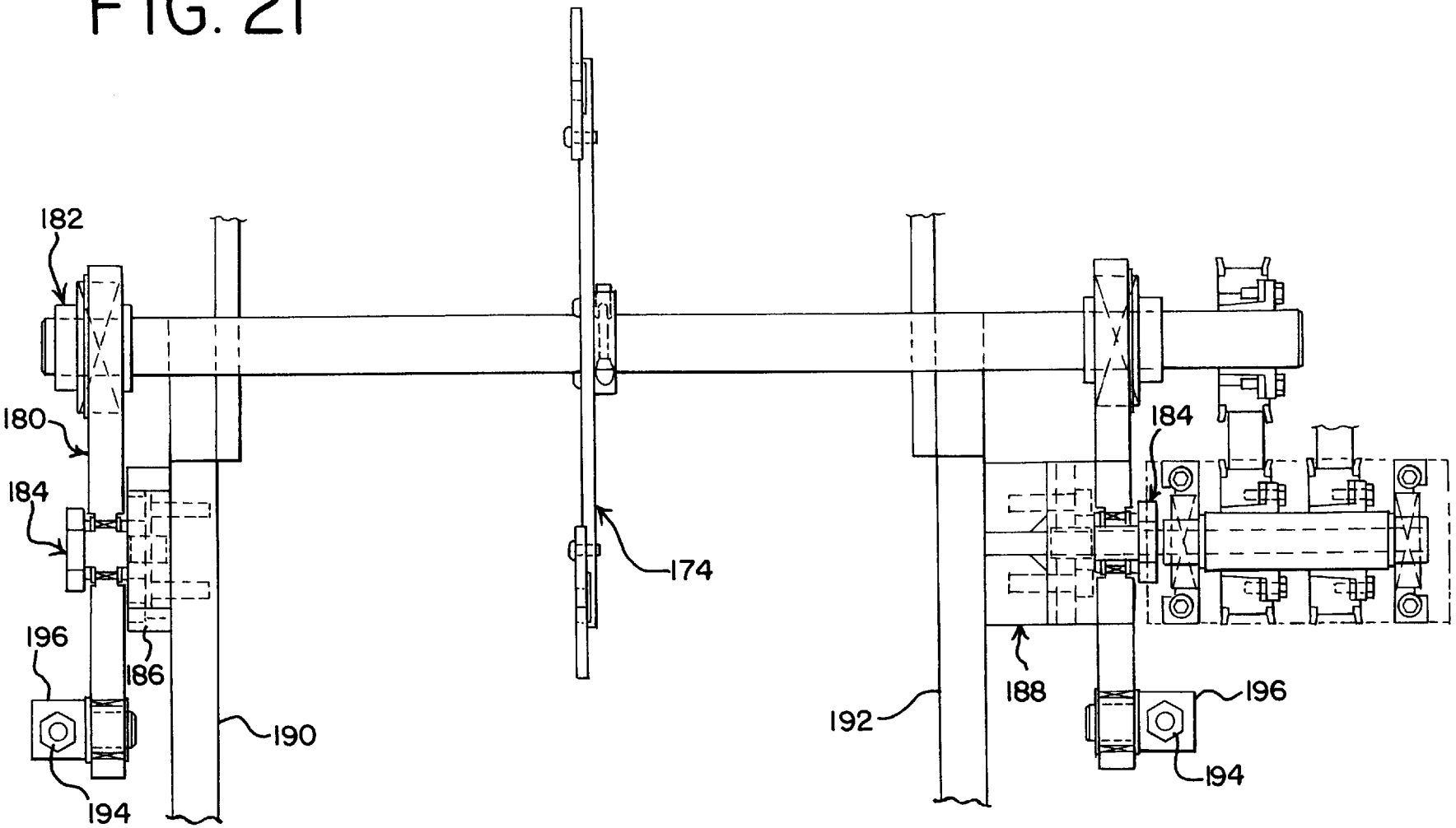
FIG. 21 is a plan view of the upper throw-off and height adjustment system.
Figure 22:
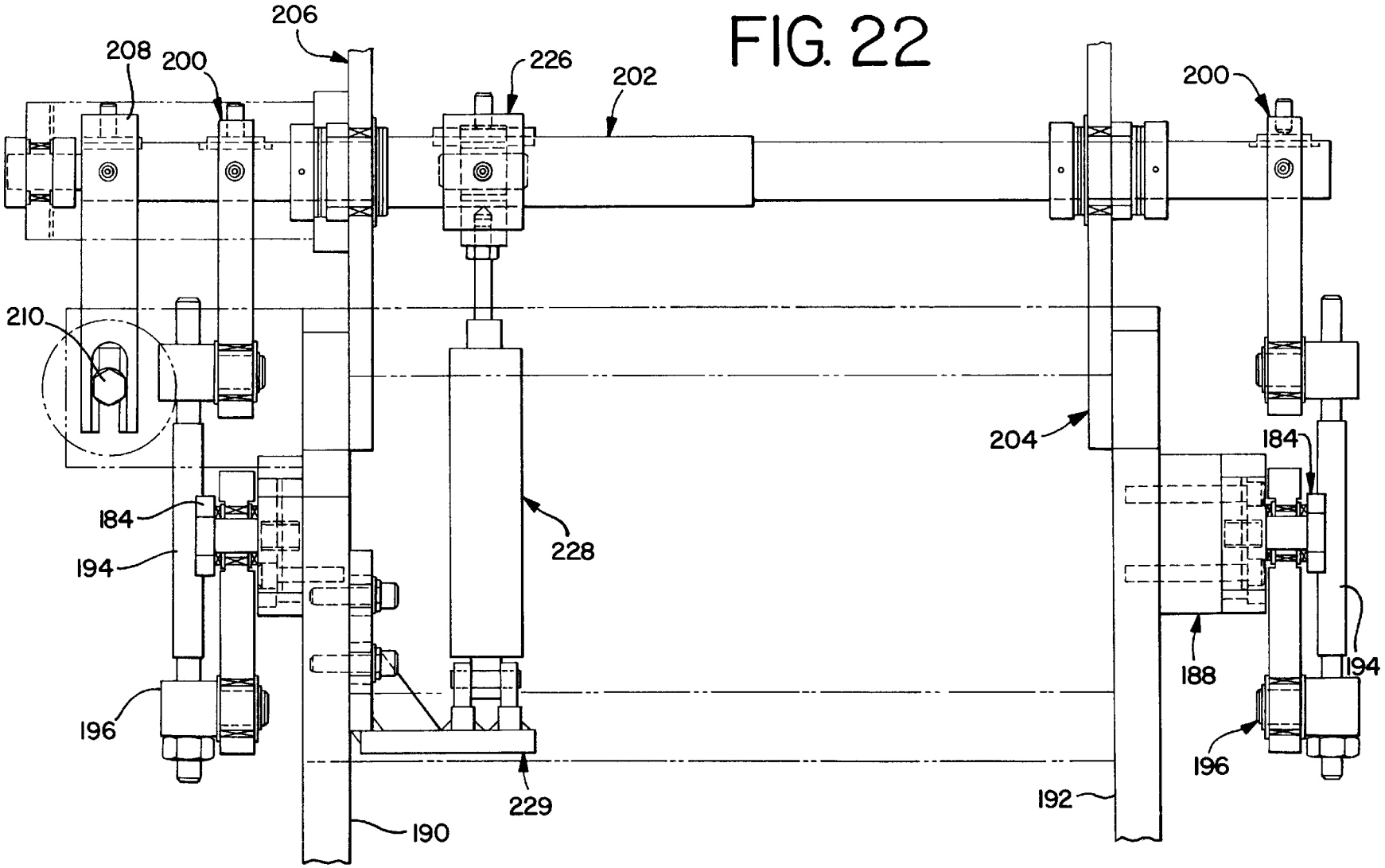
FIG. 22 is a plan view of the lower throw-off and height adjustment system.

Referring to FIGS. 20, 21, and 22, arms 180 are supported by bearinged studs 184. The shaft 178 is supported in the arms 180 by bearings 182. The arms 180 are pivotable about bearinged studs 184, which are mounted to an operating support block 186 and a drive side support bracket 188, which can be horizontally adjusted for alignment relative to each other and for horizontal position relative to the delivery frames 190, 192 on which they mount. The drive side bracket 188 also provides support for the driving components, which rotates the transition wheels 174 and support shaft 178 at the correct speed and phase relationship in accordance with the products passing below. This is accomplished via a stepper motor controlled by compatible electronic position sensing equipment, and, timing belt and drive pulley components. The pivotable arms 180 are rotationally controlled by adjusting shafts 194. The adjusting shafts 194 pass through, and are fixed to bearinged studs 196 mounted on the 180 arms. The other end of the adjusting shafts 194 are threaded through bearinged studs 198 mounted on levers 200. Referring to FIG. 22, the levers 200 are mounted to a trip shaft 202, which spans the delivery system and is bearing supported by the belt roller frames 204, 206. In combination with the above assembly of parts, the rotational position of the trip shaft 202, determines the height of the transition wheels 174 above the product. The normal running position of the trip shaft 202 is controlled by a stop lever 208, one end of which is affixed near the operating side trip shaft end. Referring to FIG. 20, the other end of the stop lever 208 mounts a stop pin 210. The weight of the transition wheel/support shaft parts creates a force, which is transmitted to the stop pin 210 in the stop lever 208 via connecting parts, which pushes upward against an opposing mechanism. This mechanism includes an adjustable stop nut 212, which directly opposes the stop pin 210; an adjustable stop rod 214, which passes through and is guided by the stop pin 210; a threaded pivot pin 216, which is supported by a block 218 mounted on the delivery frame 190, and through which the upper end of the adjustable stop rod 214 passes; and an adjusting knob 222 affixed to the extended upper adjustable stop rod end. Pre-loaded compression springs 224, mounted on the rod 214 below the threaded pin 216, create a torsional locking friction between the adjustable stop rod 214 and the pin 216, which prevents unwanted adjustment changes caused by shock load or vibration. This arrangement provides the operator with the capability of adjusting the height of transition wheels 174 relative to the products passing below; which directly affects the product control envelope. Typically, the best control envelope configuration is attained while running since the effect of even a minor adjustment change is immediately observable; which is a very useful capability.

In the embodiment shown, the transition wheels 174, may be quickly raised, for example, about 1½ inches from their normal run position or quickly returned to their normal running position from the raised, or throw-off position at the discretion of the operator. This is called the transition wheel throw-off feature. During start-up, product flow upsets or wads of paper and irregularities are common. Throwing off or raising the transition wheels 174, permits these upsets to pass through without causing more serious product stream interruptions. Severe jams can be more easily removed. The transition wheels 174 are also automatically raised when the top belt system is raised; and cannot be lowered when the top belt system is in the raised position. The mechanism providing this capability includes a lever 226, which is fastened or keyed to the throw-off shaft 202, at one end and to an air cylinder 228, at the other end. The air cylinder 228, is rotatably connected at a first end to lever 226 and at its other end to frame support bracket 229. The support bracket is anchored to the operating side frame and actuated with manual, operator controlled, air valves. The actuation of the air cylinder 228 causes the throw-off shaft 202 to rotate to the throw-off position, which, via the assembly of parts previously mentioned above, overcomes the gravitational forces which keep the wheels 174 in the normal, downward, running position. This throw-off feature is useful during make-ready to allow the product to be synchronized relative to the transition wheel, while the wheel 174 is in the throw-off position.

Referring to FIGS. 1 and 23, the system 10, is designed to receive paper or paper-like products 280 from the adjacent cutting module 22 (typically, a Rotary Cut-off machine), which have been cut to length, and then place these products in shingled moving streams 281. These streams are either transferred to a stacking machine or stacked by hand. The stacked product is than prepared for shipping. A large range of product length, width, and configuration can be accommodated. Referring to FIGS. 2, 3, and 23, the web-product 280 is cut to product length. The leading edge of the product 280 enters nip 90, which is formed between the leading idler roller 60 of top belt and the bottom belt drive roller 91. Both top and bottom belt/roller surfaces are moving equal to or faster than the product before the trailing edge of the product is cut. After the trailing edge is cut, the product speed is determined by the speed of the bottom roller/belt speed-up system 14. Typically, a small amount of speed-up is used to create head-to-tail-separation between products 280. The top belts match the speed of the bottom roller/belts and, together, produce an envelope of control surface's which transfers the product to the first stage slow-down system 16, with consistent repeatability. As the product transitions from the speed-up system 14, to the first stage slow-down system 16, the slower moving products must be placed into a "shingle" configuration, in that the faster, over taking product leading edge must pass over the trailing edge of the product ahead. This is facilitated by transition wheels 174.

Figure 17:
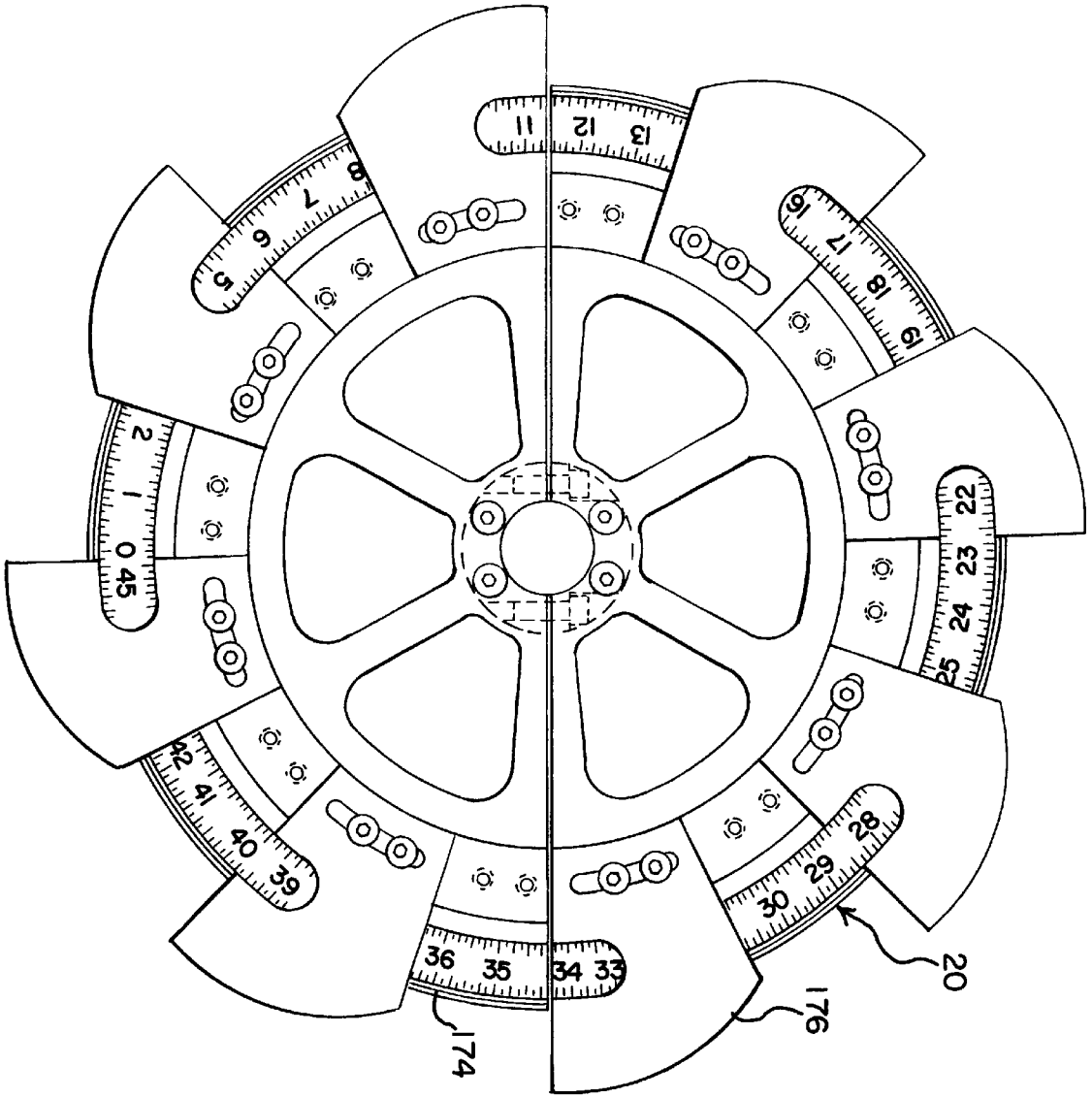
FIG. 17 is a side view of a preferred embodiment of the transition wheel assembly.

Referring to FIG. 17, the transition wheel assembly 20 includes a transition wheel 174, including one or more cam-like curved surface members 176 about its periphery. FIG. 19 shows an alternative embodiment of the transaction wheel assembly 21 including curved plates 301, 302, which each have a plurality of curved or transition surfaces 303 to contact with the product moving along the product path. Curved surface members 176, about the periphery of the transition wheels 174, contact the top surface of the product while moving in the same direction. The rotating wheels 174, are located along the product path so that product contact occurs over the start of the first stage slow-down belt, which is lower and immediately after the bottom roller/belt speed-up system. Rotation is phase adjusted so that the curved surfaces 176 initiate contact with the product toward the leading edge as the product exits the speed-up system, and progressively displace the product downward toward the first stage slow-down belt as the product passes underneath. Product contact is completed near the trailing edge finalizing the vertical separation, thus allowing the leading edge of the following product enough space to pass over the trailing edge. The curved displacement surfaces 176 do not slow the product. Although the curved surfaces 176 at the line of contact are moving in the same direction as the product, the surface speed can be faster or slower than the product surface.

As the trailing edge of the product completes its vertical separation, the product status is as follows: the product is clear of the bottom roller/belt speed-up system 14, and is totally over the first stage slow-down system 16. The leading edge is in contact with the top belts, which direct the product toward the stop wheel-first stage slow-down nip 23. The maximum extension of the transition wheel displacement curved surface is in contact with the product near the trailing edge.

Referring to FIG. 16, stop wheels 177, are located slightly down stream from the leading edge of the product in the status defined above. The stop wheels 177 ride on top of the first stage-slow down belt 179 and subsequently create the shingled product stream. The surface speed of the stop wheel 177 perimeters match the speed of the first stage belt since the belt is the driving element. The axis of the stop wheels are crosswise to the shingled product/belt path placing the wheel rotations in a vertical plane and forming a nip 23 between the stop wheel perimeters and the first stage slow-down belt 179 below. As mentioned above, the leading edge of the product traveling at the speed-up system speed is directed into the nip 23. Enough downward force is exerted by the stop wheels 177 to cause the product to slow-down and match speed with the shingled product stream riding on the first stage slow-down belt 179. This downward force is pneumatically controlled. Only one stop wheel 177, may be needed to accomplish this product speed reduction if the product configuration is suitable; typically, narrow and stiff. Two or more stop wheels 177, may be used when one stop wheel cannot maintain product-shingling consistency. Some product configurations may be run best with additional stop wheels.

Considerable product control is required to decelerate the product and attain a shingled configuration, as shown in FIG. 23, especially when light-bodied single sheets ate involved. As speeds increase, the trailing part of the product tries to overtake the leading edge when the leading edge is abruptly slowed resulting in buckling and unacceptable creasing of the product. To prevent this, considerable control of the top and bottom surface is required. This can be accomplished by maintaining a very close envelope which is defined by the top belts 58 and transition wheel surfaces above, and the first stage slow-down belt 179, below. Width of the envelope across the product path can be controlled by the number of top belt arrangements, transition wheels, and bottom belts used and how they are positioned. Thickness (vertical space) of the envelope under the transition wheels 174, is determined by the first stage bottom belt 179 and the top belt 58 vertical distance relationship which is adjustable, and the transition wheel height above the bottom belt, which is also adjustable. The envelope thickness beyond the transition wheel is controlled by the path of the top belts relative to the bottom first stage slow-down belt/shingled product path to the end of the first stage slow-down. After passing under the first stage slow-down stop wheels 177, the shingled product stream exits the first stage slow-down belt and enters on to the second stage slow-down system 18 (FIG. 1). Typically, the second stage slow-down system 18 travels much slower than the first stage which increases the amount of product overlap resulting in a much more compact or "tighter" shingle configuration. Stop wheels, similar to those used at the first stage, are often used just down stream from the point of slow down going from the first stage to the second stage for improved product shingle alignment and consistency. The second stage belt section is where hand collection and stacking can be done. However, high-speed production requires a stacking machine.

A conveyer extension 21 may be attached to the exiting end of the second stage slow-down system 18 and continues moving the shingled product to the stacking machinery. The conveyer extension product support belting at the exiting end can be raised or lowered to accommodate the entry level of the stacking equipment.

The above delivery system 10, is not limited to a single product stream but is typically operated with one, two, or more product streams simultaneously. Product webs can also be placed over each other, cut as a single product, and handled through the delivery system like a single product.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

I claim:

1. An idler roller assembly for use in a web-product delivery system comprising:

a roller configured to engage a surface of a belt, said roller being rotatably attached to an arm, said arm being pivotably attached to a bracket, a pivot shaft attached to the bracket and slidably receiving a load-biased threaded adjusting rod, said adjusting rod being screwably attached to the arm, wherein the arm is rotated about the bracket through a vertical plane when the adjusting rod is turned.

2. The idler roller assembly of claim 1, further comprising a compression spring positioned between the pivot shaft at a first end and an adjustable stop member at a second end, the stop member being adjustable to alter the amount of load-bias applied to the arm by the adjusting rod.

3. The idler roller assembly of claim 2, wherein the stop member comprises a stop nut screwably attached to a threaded portion of the adjusting rod.

4. The idler roller assembly of claim 1, further comprising a screw passing through a threaded opening in the bracket and a clamping block attached to the bracket, said clamping block being configured so as to engage a bar portion of a carriage, wherein said bar portion is clamped against said clamping block by rotation of said screw.

5. The idler roller assembly of claim 1, wherein the adjusting rod is screwably attached to a stud, the stud being attached to the arm.

6. A method of operating an idler roller assembly comprising:

providing a roller rotatably attached to an arm, said arm being pivotably attached to a bracket, a pivot shaft attached to the bracket and slidably receiving a load-biased threaded adjusting rod, said adjusting rod being screwably attached to the arm in a manner such the arm is rotated about the bracket when the the adjusting rod is turned; and turning said adjusting rod to rotate the arm about the bracket so as to position the roller against a surface of a belt to modify a belt profile.

7. The method of claim 6, further comprising:

providing a screw passing through a threaded opening in the bracket;

providing a clamping block attached to the bracket; and turning the screw to secure the clamping block to a bar portion of a top belt system.

8. The method of claim 6, further comprising:

turning the adjustment rod to a point where the pressure against the belt overcomes a pre-load compression on the rod; and sliding the rod through the pivot shaft to relieve excess pressure to allow a user to visually determine that the pre-load is set.

9. The method of claim 6, further comprising a stop member adjustable along the adjusting rod; and positioning the stop member on the adjusting rod to set the load-bias on the adjusting rod.

10. The method of claim 9, wherein the stop member comprises a stop nut screwably attached to a threaded portion of the adjusting rod; and screwing the stop nut to set the load-bias on the adjusting rod.

11. An anti-jamming idler roller assembly for use in a web-product delivery system, said web-product delivery system having a belt for moving product through said web-product delivery system, said belt having a profile that is modified by said idler roller assembly, wherein said anti-jamming idler roller assembly comprises:

an L-shapped bracket having a first end and a second end;

a support arm having a first end and a second end, said first end of the support arm being pivotally attached to the second end of said bracket;

a roller configured to engage an interior surface of the belt, said roller being rotatably connected to the second end of said support arm;

a pivot shaft attached to the first end of said bracket; and a load-biased adjusting rod connected between said pivot shaft and said support arm, said adjusting rod comprising a threaded shaft and a compression spring, said adjusting rod being screwably connected to said support arm so that rotation of said adjusting rod causes said support arm to pivot relative to said bracket, said compression spring providing a biasing force to bias said adjusting rod in an extended position, said adjusting rod being slidably connected to said pivot shaft so that said adjusting rod is retractably when said roller is subjected to a force sufficient to overcome said biasing force.

12. The idler roller assembly of claim 11 wherein said adjusting rod further comprises a stop member screwably attached to said threaded shaft, said stop member being adjustable to alter said biasing force.

* * * * *

UNITED STATES PATENT AND TRADEMARK OFFICE

CERTIFICATE OF CORRECTION

PATENT NO. : 6,112,884
DATED : September 5, 2000
INVENTOR(S) : Philip V. Voorhees It is certified that error appears in the above-identified patent and that said Letters Patent is hereby corrected as shown below:

Title page,

Column 61,
Line 1, under "U.S. PATENT DOCUMENTS", delete "12/1930" and substitute -- 2/1925 -- in its place.

Column 1,
After line 2, insert the following:

| | | | |
|---|---|---|---|
| -- 3,315,956 | 4/1967 | Lyman | 271/202 |
| 4,436,302 | 3/1984 | Frye et al. | 271/183 |
| 4,548,404 | 10/1985 | Brandt et al. | 271/202 --. |

After line 3, insert the following:

| | | | |
|---|---|---|---|
| -- 4,867,435 | 9/1989 | Cogswell et al. | 271/202 |
| 4,898,373 | 2/1990 | Newsome | 271/202 |
| 5,249,790 | 10/1993 | Brame et al. | 271/202 |
| 5,797,598 | 8/1998 | Marschke et al. | 271/202 --. |

Claim 11,
Line 7, delete "L-shapped" and substitute -- L-shaped -- in its place.
Line 24, delete "retractably" and substitute -- retractable -- in its place.

Signed and Sealed this

Twentieth Day of November, 2001

*Attest:*

Nicholas P. Godici

*Attesting Officer*

NICHOLAS P. GODICI
*Acting Director of the United States Patent and Trademark Office*